United States Patent [19]

Shiba et al.

[11] Patent Number: 5,075,204

[45] Date of Patent: Dec. 24, 1991

[54] SILVER HALIDE COLOR PHOTOSENSITIVE MATERIAL HAVING A REFLECTIVE SUPPORT AND A SPECIFIED VOLUME RATIO

[75] Inventors: Keisuke Shiba; Tadashi Ogawa, both of Kanagawa, Japan

[73] Assignee: Fuji Photo Film Co., Ltd., Kanagawa, Japan

[21] Appl. No.: 492,501

[22] Filed: Mar. 13, 1990

[30] Foreign Application Priority Data

Mar. 13, 1989 [JP] Japan ..... 1-59750

[51] Int. Cl.[5] ..... G03C 1/46; G03C 1/76; G03C 1/87

[52] U.S. Cl. ..... 430/496; 430/502; 430/524; 430/525; 430/545; 430/627; 430/503

[58] Field of Search ..... 430/896, 502, 524, 525, 430/627, 545, 503

[56] References Cited

U.S. PATENT DOCUMENTS

| | | | |
|---|---|---|---|
| 1,906,199 | 4/1933 | Rado | 430/525 |
| 2,694,639 | 11/1954 | Nadeau et al. | 430/525 |
| 4,783,394 | 11/1988 | Hirose et al. | 430/380 |
| 4,833,069 | 5/1989 | Hamada et al. | 430/496 |
| 4,851,327 | 7/1989 | Fuchizawa et al. | 430/525 |
| 4,894,321 | 1/1990 | Ogawa et al. | 430/496 |
| 4,901,295 | 3/1990 | Fachizawa et al. | 430/272 |

*Primary Examiner*—Charles L. Bowers, Jr.
*Assistant Examiner*—Patrick A. Doody
*Attorney, Agent, or Firm*—Sughrue, Mion, Zinn, Macpeak & Seas

[57] ABSTRACT

A silver halide color photosensitive material comprising a support having a metal surface with secondary diffuse reflection and a total reflectance of 0.5 or more in the visible wavelength region of 420 to 680 nm, said support having provided thereon a photosensitive silver halide emulsion layer containing a yellow coupler, a photosensitive silver halide emulsion layer containin a magenta coupler, and a photosensitive silver halide emulsion layer containing a cyan coupler and at least one non-photosensitive hydrophilic colloid layer, wherein the volume ratio R of the hydrophilic constituents in each photosensitive silver halide emulsion layer with respect to the non-hydrophilic constituents therein is 1.30 or less, and the photosensitive silver halide emulsion layer containing a color coupler which is arranged nearest the support has an R value of 1.20 or less.

22 Claims, 1 Drawing Sheet

SILVER HALIDE COLOR PHOTOSENSITIVE MATERIAL HAVING A REFLECTIVE SUPPORT AND A SPECIFIED VOLUME RATIO

FIELD OF THE INVENTION

This invention relates to a silver halide color photosensitive material comprising a support having a metal surface with secondary diffuse reflection properties. In particular, it relates to a color photosensitive material for printing comprising a support having a surface of a metal such as aluminum or an alloy thereof with diffuse reflective properties providing a total reflectance of at least 0.5, wherein the photosensitive material is not prone to film peeling, and wherein the photosensitive material may undergo development processing common to conventional color photosensitive materials which employ supports of paper, polyethylene-laminated paper or the like.

BACKGROUND OF THE INVENTION

Conventionally, for black-and-white printing papers and color printing papers, silver halide photosensitive layers and protective layers are provided on reflective supports (such as baryta paper and resin-coated paper). These reflective supports are provided by using white pigment of a fine powder of a transparent inorganic material having a high refractive index, dispersed in a plastic film or by milling the pigment together with a sizing agent and white base paper.

JP-A-49-33783 (the term "JP-A" as used herein means an "unexamined Japanese patent application") discloses a photographic material having a layer of mixed microcapsules containing silver halide emulsions with different light wavelength sensitivity regions coated onto an aluminum support with a surface having a metallic gloss, namely, a mirror surface. JP-A-62-21147 discloses a color printing paper comprising a support comprising a non-directional frosted surface of metal foil having provided thereon a resin layer.

Supports having surfaces with mirror surface reflectance and secondary diffuse reflection properties, as defined, for example, in the first paragraph of Chapter 18 of *Shikisai Kagaku Handobukku* (The Handbook of Color Science, The Japanese Color Study Association, 5th edition, 1985, published by Tokyo University Publishing), are disclosed in JP-A-61-210346, JP-A-63-118154, JP-A-63-24247, JP-A-63-24251, JP-A-63-24252, JP-A-63-24253, JP-A-63-24255 and JP-A-63-70844.

SUMMARY OF THE INVENTION

With color photosensitive materials comprising supports having metal surfaces with a mirror surface reflectance or secondary diffuse reflection properties, film peeling is liable to occur. Particularly, processing solutions infiltrate therein from the cut surfaces or edges during development processing, especially when the constituent material of the surface of the support is a metal such as aluminum or an alloy thereof. The film peeling still occurs even when a thermoplastic resin layer has been provided between the metal support and the emulsion layer. Furthermore, it is difficult to wash out the infiltrated processing solution adequately before the completion of processing and staining occurs over time. Furthermore, tar formation or strong coloring is liable to occur.

Indeed, these disadvantages readily stand out since image sharpness, color saturation and the like are particularly outstanding in printed photographs obtained from color photosensitive materials comprising supports having mirror-surface reflection or secondary diffuse reflection and which comprise, in particular, photosensitive layers composed of a fine grained dispersion of color couplers with auxiliary agents such as an oil or a polymer.

Furthermore, with color photosensitive materials comprising such supports, processing variations such as the occurrence of fogging and a softening of gradation increase as continuous development processing progresses. Accordingly, with these color photosensitive materials, it is not possible to carry out color development processing together with color printing papers which make use of normal (primary diffuse) reflective supports.

There is no known means for solving the various color development processing problems which occur when using supports of this particular type.

An object of the present invention is to provide a photosensitive material which solves above noted problems. Thus, a first objective of the invention is to provide a silver halide color photosensitive material comprising a support having a metal layer with secondary diffuse reflection which provides particularly good image sharpness and high saturation in the color reproduction, and which provides particularly good luminance at ordinary viewing angles, without increasing edge contamination, film peeling or staining. A second objective of the present invention is to provide a silver halide color photosensitive material comprising a support having a metal surface with secondary diffuse reflection, which is capable of undergoing a color development process common to color photosensitive materials having conventional reflective supports and with which the processing changes are slight.

The present inventors have analyzed the film peeling which occurs in the development processing stages for color photosensitive materials comprising supports having metal surfaces with mirror reflection or secondary diffuse reflection. The present inventors have discovered that the objectives of the pesent invention are attained by:

(1) A silver halide color photosensitive material comprising a support having a metal surface with secondary diffuse reflection and a total reflectance of 0.5 or more in the visible wavelength region of 420 to 680 nm, said support having thereon a photosensitive silver halide emulsion layer containing a yellow coupler, a photosensitive silver halide emulsion layer containing a magenta coupler, a photosensitive silver halide emulsion layer containing a cyan coupler and at least one non-photosensitive hydrophilic colloid layer, wherein the volume ratio R of the hydrophilic constituents in each silver halide photosensitive layer with respect to the non-hydrophilic constituents therein is 1.30 or less, and the silver halide photosensitive layer containing a color coupler which is arranged nearest the support has an R value of 1.20 or less.

(2) A silver halide color photosensitive material as described in (1), wherein the silver halide photosensitive layer arranged nearest the support has an R valaue of 1.00 or less.

(3) A silver halide photosensitive material as described in (1) or (2), wherein the average roughness in the center of the metal surface of the support is 0.1 to 2.0 $\mu$m.

(4) A silver halide photosensitive material as described in (3), wherein the R value of each of the photosensitive layers is 1.25 or less and the silver halide photosensitive layer containing a color coupler which is arranged nearest the support has an R value of 0.90 or less.

BRIEF DESCRIPTION OF THE DRAWINGS

FIG. 1 shows a subbing layer 1, bonding layer 3, aluminum foil 5, anchor layer (PE) 7, and a base comprising base paper 9 and PE film 11.

FIG. 2 shows matting agent 13, bonding layer 15, aluminum thin film 17, base (1) comprising PET film 19, anchor layer (containing a bonding agent) 21, and base (2) comprising PE film 23, base paper 25 and PE film 27.

DETAILED DESCRIPTION OF THE INVENTION

Figure 1:
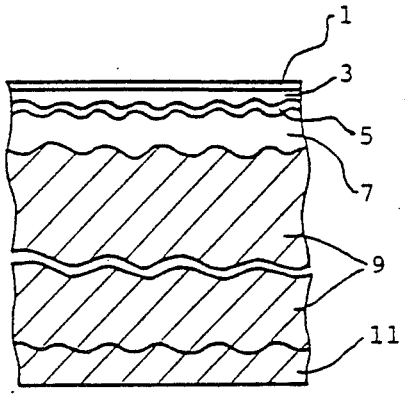
FIG. 1 and FIG. 2 are cross-sectional views of the support in accordance with the present invention, as described in Examples 1 and 2 respectively.

The invention is describe in detail below.

A primary characteristic of the present invention is the support and, in particular, the surface thereof.

Mirror reflection refers to a smooth surface having reflective properties in accordance with the law of regular reflection of light, and the total reflectance is preferably 0.5 or more. In contrast to when the surface of the constituent material is smooth or mirrored, a secondary diffuse reflection is the diffuse reflection which is obtained by dispersion of the angle between each reflecting surface and the incident light, either by providing irregularities in the surface or by finely dividing the surface. Secondary diffuse reflection is also referred to as a collection of "small mirror surface reflections". In particular, a surface which provides strongly diffused reflected light at a viewing angle (the angle between the normal line and the viewing orientation) of 0° to 45° , and in particular 10° to 30° is preferred. In this invention, the support having the metal surface with a secondary diffuse reflection is advantageous in that the film does not tend to peel. A surface irregularity for secondary diffuse reflection of 0.1 to 2,000 irregularities/mm is acceptable as the frequency for a roughness of 0.1 μm or more, and the three-dimensional average roughness (SRa) with respect to the central plane is generally 0.1 to 2.0 μm and preferably 0.1 to 1.2 μm.

A secondary diffuse surface is closer to a mirror reflection if it has less than 0.1 irregularities/mm, and the intensity of the diffused reflected light is reduced from the preferred viewing angle of, for example, 10° to 30° if there are more than 2,000 irregularities/mm. A surface quality with a high luminance and a high-class feel will be exhibited, particularly at the preferred viewing angle, when the frequency of roughness is 0.1 to 2,000 irregularities/mm and particularly 50 to 600 irregularities/mm. It is possible to measure the frequency and surface roughness to the central plane by cutting in the cross-section of the support and counting the irregularities using an electron microscope or by examining the form of the surface using a three dimensional roughness measuring device such as the Model SE3AK made by Kosaka Kenkyusho (KK).

The total reflectance of the surface with a secondary diffuse reflection in accordance with the present invention is 0.5 or more, and preferably 0.6 to 1.00 in the wavelength region of 420 to 680 nm. The total reflectance can be measured using a spectrophotometer such as the Model 307 Color Analyser made by Hitachi Seisaku-sho. The constituent material used in the surface portion of the support may be silver, aluminum, magnesium or alloys thereof. Spectro reflectances of these materials are disclosed in *J. Opt. Soc. Amer.* by F. Benford et al., Vol. 32, pp. 174 to 184 (1942). Metals and their alloys which have a reflectance of 0.5 or more when the surface is smooth are useful as the supports of the present invention. Aluminum and alloys thereof, for example, alloys of aluminum with at least one of magnesium, zinc, tin and copper, are particularly preferred. Surfaces can be obtained from these metals by providing a metal plate or metal thin film on another base.

Metal plates can be obtained by the molten rolling processing of the metal. Thinner foils of the metal can be obtained by rolling to about, for example, 1 to 100 μm. The support in the pesent invention is obtained by laminating the metal thin film onto a base. An anchor layer may be provided between the base and the metal thin film. Furthermore, 1 or 2 or more thin film layers of the metal constituent material may be provided on pretreated(so as to satisfy the definitions of the present invention) bases or pre-treated anchor layers by a vacuum evaporation deposition process, a sputtering process, an ion plating process, electrodeposition, electroless plating or the like. Vacuum evaporation deposition is preferred. The thickness of the thin film is preferably 300 Å to 1 μm and more preferably 1,000 Å to 0.5 Åm.

With the secondary diffuse reflection surface, a metal foil which has been previously provided with irregularities may be provided on a base, anchor layer or the like, or the metal thin film can be attached to a base, anchor layer or the like which has been previously provided with irregularities. Details are described, for example, in JP-A-61-210346, JP-A-63-118154, JP-A-63-24247, JP-A-63-24251 to JP-A-63-24255, JP-A-1-189646 and JP-A-1-185551.

Preferred secondary diffuse reflection surfaces are those having diffused spectral reflectance of 0.5 or more, preferably 0.6 to 1.0 and more preferably 0.7 to 1.0 in the 420 to 680 nm wavelength region. This diffused spectral reflectance can be measured by trapping the regularly reflected light and using an integrating sphere to condense the remaining reflected light.

The irregularities in the surface with the preferred secondary diffuse reflection not only enlarge the viewing angle of strong diffused reflected light, but are also effective in improving of the adhesion with the bonding layer and in reducing the occurence of film peeling during processing.

When the diffused spectral reflectance is less than 0.5, the diffused reflected light is inferior to that from commonly used supports for color printing papers including resin coated paper, even at the preferred viewing angle, such that the characteristic features of the support are lost.

The average roughness in the center of the metal surface of the support is preferably 0.1 to 2.0 μm in view of the constitution of the secondary diffuse reflection surface. When the roughness is within this range a surface having a high luminance and a high quality feeling is obtained. When the roughness is less than 0.1 μm the surface reflection tends to become that similar to a mirror reflection, on the other hand, when the roughness is larger than 2.0 μm, the total reflectance is liable to lower and liable to provide a surface with a rough feeling.

The preferred structure of the support of the present invention is, in order, a base, anchor layer, a metal thin film, subbing layer or the like. The anchor layer provides adhesion between the base and the metal thin film as well as diffuse reflection properties.

The subbing layer may be provided on a bonding layer and also provides an antihalation effect.

Examples of the structural sequencess of the supports of the present invention are given below. However, the invention is not limited thereto.

(1) Metal thin film/anchor layer/base
(2) Metal thin film/base (1)/anchor layer (including a bonding agent)/base (2)
(3) Metal thin film/anchor layer/base/antistatic layer
(4) Metal thin film/base (1) (matting surface)/anchor layer/base (2)/antistatic layer
(5) Metal thin film/base (matting surface, introducing a matting agent to the base or introducing a bonding agent to the surface structure of the base to provide an anchor layer effect)/antistatic layer
(6) Subbing layer/metal thin film/anchor layer/-base/antistatic layer, etc.

The constituent layers of the support according to the present invention are described below.

The base for use in the present invention may be selected from known base materials for supports. Examples include polyethylene terephthalate, polybutylene terephthalate and other such polyester films, cellulose triacetate films, polystyrene films, polypropylene films, polyethylene and other such polyolefin films, and nylon films and other such plastic films; and when matting the surface, the base materials may be filled with pigments, coated with pigments or may be subjected to a mechanical process. Useful pigments for filling the base materials include silica, titanium dioxide, barium sulfate, calcium sulfate, barium carbonate, calcium carbonate, lithopon alumina white, zinc oxide, antimony trioxide and titanium phosphate. These pigments can be used alone or in combination. The grain size of the pigments is preferably 0.5 to 8 μm. Furthermore, it is desirable that the amount of pigment to be incorporated into the base material is preferably from 1 to 10 wt %. When dispersing these pigments in a resin, it is possible to use surfactants, for example, metal soaps such as zinc stearate and aluminum stearate, as dispersants.

The above substances can also be used as the pigments for effecting the matting using a pigment coating. Water-soluble binders, and binders of water-dispersed systems and non-aqueous systems may be used as the binder, in addition to appropriate binders selected from "Saishin Bainda Gijutsu Binran" (Recent Binder Technology Handbook), edited by the Sogo Gijutsu Senta (Combined Technology Center); 1985. Gelatin, PVA, casein and the like can be used as water-soluble binders. In such cases, it is desirable to use a hardener. Water-dispersion systems include butadiene copolymer latexes, vinyl acetate resin emulsion, acrylic emulsion, polyolefin-based emulsions and the like. Useful non-aqueous binders include polyesters, a vinyl acetate based binder, thermoplastic elastomers, polyurethanes, and a melamine, urea alkyd, acryl and phenol based binders.

The matting may be carried out using a mechanical process such as the sanding process, wherein fine grains of an abrasive are ejected in a jet stream.

A metal thin film layer is provided on the film or matted film described above.

The metal thin film may be provided using known methods for producing thin films such as vacuum evaporation deposition, sputtering, ion plating and electrodeposition. The metal thin film may be a single layer or may be a multilayer of two or more layers.

The thickness of the metal thin film layer is preferably 300 Å or more.

Plastic films provided with metal thin films may be employed as the support as such, or they may be employed as the support after being adhered to another plastic film, paper, RC-paper (resin-coated paper), synthetic paper, metal plate or the like or with plates of polymer or copolymer such as polycarbonate, polystyrene, polyacrylate, polymethacrylate, PET and the like materials which having good dimensional stability.

In the present invention, known lamination methods may be used, for example, those described in *Shinlamineto Kako Binran* (New Laminate Processing Handbook) edited by the Kako Gijutsu Kenkukai (The Processing Technology Research Association), 1983, and it is preferable to adopt a dry lamination.

Furthermore, in the present invention, an anchor layer may be provided between the base and the metal thin film.

A copolymer of vinylidene chloride, vinyl chloride and anhydrous maleic acid is preferred as an anchor coating agent for use in the anchor coating layer, and copolymer components other than these may also be included. For example, it is possible to use a four-element copolymer of vinylidene chloride, vinyl chloride, anhydrous maleic acid and vinyl acetate have been copolymerized.

In this case, the repeating units derived from vinyl acetate constitute preferably 20 wt % or less.

The copolymers of vinylidene chloride, vinyl chloride and anhydrous maleic acid described above are preferably copolymers with (a) 5–70% by weight of unites derived from vinylidene chloride, (b) 20–80% by weight of units derived from vinyl chloride and (c) 0.1–5% by weight of units derived from anhydrous maleic acid.

If the copolymer comprises less than 5% by weight of units derived from vinylidene chloride, the hydrophobic properties are reduced and the film strength of the anchor coating layer disadvantageously weakens when wet. If the copolymer comprises less than 20% by weight of units derived from vinyl chloride, the solubility of the copolymer in organic solvents is ddisadvantageously reduced.

Furthermore, the polyurethane urea resin for use in the binder layer may be added to the anchor coating layer. The proportion of vinylidene chloride, vinyl chloride and anhydrous maleic acid copolymer to polyurethane urea resin is preferably 100/0 to 40/60 on a weight basis. If the proportion of polyurethane urea resin is greater than 60% by weight, there is insufficient adhesion between the anchor coating layer and the plastic film.

The anchor coating layer must be thin and uniform on the plastic film surface, and preferably has a thickness of from 0.01 μm to 5 μm. When the thickness is less than 0.01 μm, bonding imperfections tends to occur in the metal reflection layer, and when the thickness is greater than 5 μm, cost becomes a factor.

Furthermore, it is also possible to incorporate inorganic or organic pigments with an average particle size of from 0.2 to 5 μm in the anchor coating layer.

The anchor coating layer may be coated using the methods described in JP-A-51-114120, JP-A-54-94025 or JP-A-49-11118. More specifically, the film coating may be carried out by dip coating, air knife coating, curtain coating, roller coating, doctor coating, wire bar coating, slide coating, gravure coating or reverse coating.

An antistatic layer is preferably provided on the surfce of the support opposite to the surface whereon the metal layer is provided. The electrical resistance of this surface is $10^{10}$ Ω (ohm) or less. If the electrical resistance is more than $10^{10}$ Ω, there is the risk that there a large amount of static electricity may build up during the production and working processing of the photosensitive material, and static marks result or electric shock is sustained during handling due to electrical discharge. There is a particular risk when plastic films or papers having an insulating film are used as bases.

For an antisatic layer, it is preferred to use fine particles of at least one type of conductive metal oxide having crystalline properties selected from ZnO, $TiO_2$, $SnO_2$, $Al_2O_3$, $In_2O_3$, $SiO_2$, MgO, BaO and $MoO_3$, or a composite oxide of these, dispersed in a binder.

Particles of a metal oxide having crystalline properties are preferred as the conductive particles. Those metal oxides having an oxygen deficiency and those which contain a small amount of other atoms forming donors with respect to the metal oxides are particularly preferred in that they generally have a high conductivity, and the latter is particularly preferred because the metal oxides containing the donor atoms do not cause fogging in silver halide emulsions. Examples of useful metal oxides include ZnO, $TiO_2$, $SnO_2$, $Al_2O_3$, $In_2O_3$, $SiO_2$, MgO, BaO and $MoO_3$ or complex oxides thereof, and ZnO, $TiO_2$ and $SnO_2$ are particularly preferred. Of the examples containing heterogeneous atoms, those involving the addition of Al, In, or the like to ZnO, the addition of Sb, Nb, a halogen element or the like to $SnO_2$, or the addition of Nb, Ta or the like to $TiO_2$ are useful. The heterogeneous atoms are added in an amount preferably from 0.01 mol % to 30 mol % and particularly preferably from 0.1 mol % to 10 mol %.

The metal oxide particle size is preferably 10 μm or less and at 2 μm or less they will be easy to employ with good stability after dispersion. Furthermore, in order to minimize the light dispersion properties, it is particularly preferred to use conductive particles of 0.5 μm or less to obtain transparent properties.

Useful binders for dispersing the above described metal oxides include water-soluble binders, water-dispersion binders and non-aqueous binders. Gelatin, PVA, casein and the like can be used as the water-soluble binder. In such cases, it is desirable to use a hardener. Useful binders of water-dispersion systems include butadiene copolymer latexes, vinyl acetate resin emulsions, acrylic emulsions and polyolefin-based emulsions. Useful non-aqueous binders include polyesters, vinyl acetate based binders, thermoplastics, elastomers, polyurethanes, and a melamine, urea, alkyd, acryl and phenol based binders. Furthermore, known conductive high polymers can be used for part or all of the binder. These compounds include, for example, polyvinylbenzenesulfonates, polyvinylbenzyltrimethyl ammonium chloride, the quaternary polymers disclosed, for example, in U.S. Pat. Nos. 4,108,802, 4,118,231, 4,126,467 and 4,137,217, and the crosslinked polymer latexes disclosed, for example, in U.S. Pat. No. 4,070,189 and OLS 2,830,767 (U.S. Ser. No. 816,127).

The amount of conductive particles are used in an amount such that the surface electrical resistance is less than $10^{10}$ Ω. The amount used varies in accordance with the type of conductive particle, but is generally from 0.05 to 20 g/m$^2$.

In order to use the conductive particles more effectively and to reduce the surface electrical resistance, it is preferable to increase the volume content of conductive particles within the layer, although at least about 5% of binder is needed to ensure sufficient layer strength. A volume content within the range of from 5 to 95% is preferred for the conductive particles of the antistatic layer.

However, the above described range varies in accordance with the coating method, and the form and type of base employed.

In order to reduce the surface electrical resistance, a layer consisting of colloidal alumina may also be used in the present invention.

A useful colloidal alumina for use in the present invention is fibrous alumina (hydrate) havaing an average particle size of about 10 mμ × 100 mμ, which is maintained at pH 2.5–4.0 in an inorganic acid or an organic acid (in 10% solution of $Al_2O_3$).

A coating solution is prepared by diluting the colloidal alumina in water or an organic solvent which is miscible with water. The concentration of the colloidal alumina in the coating solution depends on, for example, the required electrical resistance or the liquid viscosity suitable for the selected coating method.

To provide a combined improvement of properties in addition to the reduction in the electrical resistance, such as the coefficient of friction, the writing properties and the color, various resins, dyes, matting agents such as silica or the like may also be added to the above described coating solution.

The same methods for coating the anachor coating layer may also be employed to coat the antistatic layer.

It is preferable to treat the base prior to coating using a method appropriately selected from, for example, corona discharge treatment, glow discharge treatment, chromic acid treatment, flame treatment, hot air treatment, ozone treatment, ultraviolet treatment and the like.

A silver halide emulsion layer is provided on the secondary diffuse reflection layer surface of the support of the present invention preferably via a bonding layer.

A water-resistant resin is used in the bonding layer. "Water-resistant resin" refers to a resin having a water content of 0.5% by weight or less. Preferred resins include those which have a bonding action on the subbing layers or the photosensitive layer provided on the bonding layer, such as the Ionomer Resins (trade name: manufactured by Mitsui Polychemical Co.) described in JP-A-63-118154, the styrene-butadiene resins described in JP-A-63-253354, the silane coupling agents described in JP-A-63-253353, the vinylidene chloride copolymers described in Japanese Patent Application 62-291486 and the mixture of vinylidene chloride copolymers and polyurethane urea resins described in JP-A-1-255856 and Japanese Patent Application 63-176327 and particularly, amongst the silane coupling agents, silanes containing epoxy groups, silanes containing isocyanate groups and aminosilanes are useful.

A mixture of vinylidene chloride copolymers and polyurethane urea resins is particularly preferred.

The above described vinylidene chloride copolymers are copolymers of vinylidene chloride, vinyl chloride, vinyl acetate and anhydrous maleic acid, and are preferably copolymers having (a) 5–80% by weight of umots derived from vinylidene chloride, (b) 20–80% by weight of units derived from vinyl chloride, (c) 5-20% by weight of units derived from vinyl acetate and (d) 0.1-5% by weight of units derived from anhydrous maleic acid.

If there is less than 5% by weight of unites derived from vinylidene chloride, the hydrophobic properties of the copolymer is diminished and the film strength of the top coating layer is undesirably weakened when wet. If the copolymer comprises less than 20% by weight or more than 80% by weight of units derived from vinyl chloride, the solubility in organic solvents is undesirably reduced.

Furthermore, if the copolymer comprises more than 20% by weight of units derived from vinyl acetate, blocking disadvantageously occurs with the rear surface of the support. Furthermore, if the copolymer comprises less than 5% by weight of units derived from vinyl acetate, discoloration of the bonding layer by the developing solution tends to occur.

If the copolymer comprises less than 0.1% by weight of anhydrous maleic acid, the strength of and bonding with the silver halide emulsion layers is undesirably weakened.

The polyurethane urea resins for use in the present invention are polymers predominantly containing urethane bonds

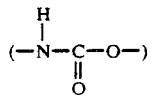

and urea bonds

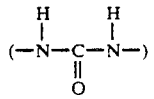

whithin the resin molelcule. The resin is obtained by a reaction of a polyvalent isocyanate or a prepolymer thereof with a poly-valent hydroxy compound or a polar liquid which forms a continuous phase.

Example of polyvalent isocyanates or polyvalent isocyanate prepolymers for use in the present invention include, for example, diisocyanates such as m-phenylene diisocyanate, p-phenylene diisocyanate, 2,6-tolylene diisocyanate, 2,4-tolylene diisocyanate, naphthalene-1,4-diisocyanate, diphenyl-methane-4,4,-diisocyanate, 3,3'-dimethoxy-4,4'-biphenyl diisocyanate, 3,3'-dimethyldiphenylmethane-4,4'-diisocyanate, xylylene-1,4-diisocyanate, xylylene-1,3-diisocyanate, 4,4'-diphenylpropane diisocyanate, trimethylene diisocyanate, hexamethylene diisocyanate, propylene-1,2-diisocyanate, butylene-1,2-diisocyanate, ethylidine diisocyanate, cyclohexylene-1,2-diisocyanate and cyclohexylene-1,4-diisocyanate, triisocyanates such as 4,4',4''-triphenylmethane triisocyanate, toluene-2,4,6-triisocyan and polymethylene polyphenyl isocyanate, and tetraisocyanate monomers such as 4,4'-dimethyldiphenylmethane-2,2',5,5'-tetraisocyanate as well as those wherein the polyvalent isocyanates have been added to compounds such as polyvalent amines, polyvalent carboxylic acids, polyvalent thiols, polyvalent hydroxy compounds and epoxy compounds, and in which two or more isocyanate groups remain within one molecule.

Examples of the polyvalent hydroxy compounds include aliphatic or amoratic polyhydric alcohols, hydroxypolyesters, hydroxypolyalkylene ethers and alkylene oxide adducts of polyvalent amines. Useful examples include catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzene, 2,4-dihydroxyethylbenzene, 1,3-naphthalenedio1,1,5-naphthalenedio1,2,7-naphthalenedio1,2,3-naphthalenediol, o,o'-biphenol, p,p'-biphenol, 1,1'-bis-2-naphthol, bisphenol A, 2,2,-bis(4-hydroxyphenyl)butane, 2,2'-bis(4-hydroxyphenyl)isopentane, 1,1'-bis(4-hydroxyphenyl)-cyclopentane, 1,1'-bis(4-hydroxyphenyl)cyclohexane, 2,2'-bis(4-hydroxy-3-methylphenyl)propane, bis(2-hydroxyphenyl)methane, xylylenediol, ethylene glycol, 1,3-propylene glycol, 1,4-butylene glycol, 1,5-pentanediol, 1,6-heptanediol, 1,7-heptanediol, 1,8-octanediol, 1,1,1-trimethylolpropane, hexanetriol, pentaerythritol, glycerine and sorbitol and aromatic or aliphatic polyhydric alcohols.

The hydroxy polyesters for use in the present invention may be obtained, for example, from polycarboxylic acids and polyhydric alcohols. Polycarboxylic acids for use in preparing the hydroxy polyesters, include, for example, malonic acid, succinic acid, glutaric acid, adipic acid, pimelic acid, maleic acid, isophthalic acid, terephthalic acid and gluconic acid. Substances such as those previously discussed are used as the polyhydric alcohol.

Useful hydroxypolyalkylene ethers include, for example, condensation products of an alkylene oxide and a polyhydric alcohol. Examples of the alkylene oxide include butylene oxide, amylene oxide and the like. and examples of the polyhydric alcohol include abaovementioned compounds.

An alkylene oxide adduct of a polyvalent amine denotes a compound wherein at least one of the hydrogen atoms in the amino moiety of the polyvalent amine is replaced with an alkylene oxide. Polyvalent amines for preparing alkylene oxide adducts of polyvalent amines include, for example, aromatic polyvalent amines such as o-phenylenediamine, p-phenylenediamine and diaminonaphthalene, and aliphatic polyvalent amines such as ethylenediamine, 1,3-propylenediamine, diethylenetriamine and 1,6-hexamethylenediamine. Useful alkylene oxide adducts include, for example, compounds such as ethylene oxide adducts, propylene oxide adducts, butylene oxide adducts, and the like.

Water is generally used as the polar liquid for forming a continuous phase, but other equivalents such as ethylene glycol, glycerine, butyl alcohol and octyl alcohol may be used.

The proportion of the vinylidene chloride-vinyl chloride-vinyl acetate-anhydrous maleic acid copolymer to the polyurethane urea resin is 95/5 to 40/60 and preferably 90/10 to 50/50 on a weight basis. With respect to the polyurethane urea resin, the adhesion with the metal reflective surface is insufficient at a ratio of less than 5% by weight, and the adhesion between the bonding layer and the silver halide emulsion layer is insufficient when the polyurethane urea resin constitutes more than 60% by weight.

The bonding layer is coated and dried. Afterwards, a pre-treatment such as corona discharge, glow discharge or fire treatment may be effectively carried out in order to strengthen the bonding with the silver halide emulsion. Furthermore, a gelatin subbing layer may be provided before the coating of the silver halide emulsion.

The bonding layer of the present invention is thin and uniform on the metal reflective layer on the surface of the support base material, and preferably has a thickness of from 0.1 to 10 μm. Bonding imperfections occur between the metal reflective layer and the silver halide photosensitive layer when the bonding layer has a thickness of less than 0.1 μm, and a thickness of more than 10 μm is not cost effective.

Furthermore, useful diluting solvents for the materials used in the bonding layers of the present invention, include ketones such as methylethyl ketone and acetone, chlorides such as triclene, esters such as ethyl acetate and butyl acetate and aromatic organic solvents such as a triol. Ethyl acetate is particularly preferred.

Furthermore, the bonding layer of the present invention differs from the anchor layer in that the bonding layer is coated on the surface of the metal thin film at the side on which a photographic layer is provided. The methods for use in coating the anchor coating layer may be useful.

The bonding layer of this invention may take the form of a multi-layer structure comprising, for example, a plurality of water-resistant resin layers. Furthermore, the combination of a layer which readily adheres to the emulsion layer and a layer which binds this layer with the metal thin film is also useful. An example of a structure comprises a subbing layer, a PET film layer and a layer bonding the PET film to the metal thin film.

A second feature of the present invention concerns the silver halide photosensitive layers, that is, a system of a hydrophilic binder containing non-hydrophilic components dispresed therein. In the color photosensitive material according to the present invention, silver halide photosensitive layers containing color couplers, intermediate layers, filter layers, protective layers and the like are generally provided on the abovementioned support via subbing layers or bonding layers.

The silver halide photosensitive layers may contain, as needed, photosensitive silver halide emulsions, color couplers, color image stabilizers, color mixing inhibitors and auxiliary dispersants for hydrophobic constituents of the same, examples of which include polymers and polymer latexes which are soluble in high-boiling (100° C. or above) organic solvents and water-insoluble organic solvents, as well as protective colloids, water-soluble surfactants and water-soluble polymers. The silver halide photosensitive layer is prepared by dispersing non-hydrophilic constituents in a hydrophilic protective colloid wherein a hydrophilic substance such as gelatin has been admixed.

The present invention is characterized in that the volume ratio (referred to as R) of the hydrophilic constituents to the non-hydrophilic constituents in each dried silver halide photosensitive layer containing color couplers is preferably 1.30 or less, more preferably 1.25 or less and particularly preferably 1.20 or less; on the other hand R is preferably not less than 0.20 and more preferably not less than 0.40; and the R value in the silver halide photosensitive layer present nearest the support is preferably 1.20 or less, more preferably 1.00 or less and particularly preferably 0.90 or less. In this way, film-peeling during the color development processing stage is avoided. Moreover, edge discoloration and the occurrence of staining is improved. In some occastion, less than 1.20 of R of a photographic layer is disadvantageous for development processing. In such a case, this can be compensated by a hydrophilic layer adjacent to the photosensitive layer. When photosensitive layers containing a color coupler which produces yellow, magenta or cyan is present in several different layers (for example in 2 or 3 layers), the R value may be calculated with respect to summed constituents of these layers. When the coupler-containing photosensitive layer present nearest to the support is divided into a plurality of layers containing the same coupler, the R value may be calculated as the sum total of the constituents of the plurality of the layers if the thickness of the total number of the layers is from about 2 to 3 μm.

As used herein a hydrophilic constituent is a binder having a water absorption saturation percentage of 60% by weight or more as measured by the ASTM D570 test (at 23±1° C.), and a substance whose volume swells by 1.5 times or more upon absorbing water. A non-hydrophilic constituent is a polymer having a water absorption percentage at 65% RH of 10% by weight or less as measured by the ASTM D570 test, or a polymer having a water absorption saturation percentage of 50% by weight or less, and a substance having a solubility in water (at 23±1° C.) is 10% by weight or less.

The volume used for the determination of the R value according to the present invention can be determined from the weight of each constituent used in the preparation of the silver halide photosensitive layer and its density. However, for constituents for which it is difficult to readily establish this value such as gelatin or a polymer, the effects of the invention may be evaluated using the following values.

For example,

| | Density [g./cm$^3$] |
|---|---|
| Silver chloride (silver chloride content 100%) | 5.6 |
| Silver chlorobromide (silver chloride content 90%) | 5.7 |
| Silver bromide (silver chloride content 0%) | 6.4 |
| Gelatin | 1.35 |
| Oil-protect type coupler used in the invention | 1.15 |
| Polymer | 1.10. |

The non-hydrophilic constituents of the invention include silver halide grains, inorganic matting agents, oil protect type (oil-soluble) couplers, polymer couplers, oligomer couplers, high-boiling organic solvents, oil-soluble polymers for dispersion, color fogging preventors, color fading preventors (or color image stabilizers), color mixing preventors, oil-soluble dyes and ultraviolet absorbers.

The hydrophilic constituents of the invention include commonly used hydophilic protective colloids such as gelatin, in addition to, for example, proteins such as gelatin derivatives, graft polymers of gelatin and other high polymers, albumin and casein; cellulose derivatives such as hydroxyethyl cellulose, carboxymethyl cellulose and cellulose sulfate esters, saccharides such as starch derivatives and sodium alginate; and various synthetic hydrophilic high molecular weight substances such as homopolymers or copolymers, for example, polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole and the like.

In addition to lime-treated gelatin, acid-treated gelatin or enzyme-treated gelatin as described in *Bull. Soc. Sci. Phot. Japan No.* 16, p. 30 (1966) can be used as the gelatin, and the hydrolysis products and enzymolysis products of gelatin may also be used.

In the pesent invention, the prevention of film peeling during the color development processing stage is pronounced if the R value in each photosensitive layer is 1.30 or less and preferably 1.25 or less and the support has a surface-roughened metal surface, and further if the R value of the silver halide photosensitive layer nearest to the support having a bonding layer or subbing layer provided therebetween is 1.20 or less (more preferably 0.90 or less). The roughness in the central plane of the metal surface is preferably 0.1 to 2 μm and more preferably 0.1 to 1.2 μm as measured by a three-dimensional roughness measurement.

The silver halide emulsion for use in the present invention is preferably a silver chlorobromide emulsion or silver chloride emulsion which essentially contain no silver iodide. Here, "essentially contain no silver iodide" is a silver iodide content of 1 mol % or less, and preferably 0.2 mol % or less.

The color photosensitive material of the present invention may constitute a color printing paper for printing purposes, reversal color printing paper or direct positive color printing paper, and the silver halide emulsions employed therein depend on the particular application. In the case of reversal color printing papers and direct positive color printing papers, silver iodobromide emulsions and silver bromide emulsions may be used.

The halogen composition of the emulsion may vary or may be uniform among the grains, although emulsions having the same halogen composition among all grains are advantageous in establishing uniform properties among all of the grains. Furthermore, regarding the halogen composition distribution within a silver halide emulsion grain, uniform composition grains, laminar structure grains wherein the halogen composition differs between the core and the shell which constitute one layer or several layers, or grain structures having portions with different halogen compositions in a non-laminar form within the grain or on the surface thereof (i.e., when on the grain surface, structures having portions with different composition joined to the edges, corners or surfaces of the grains), may be used. Laminar structure grains are generally used in direct positive color printing papers in particular. It is advantageous to use one of the latter two rather than uniform structure grains if high sensitivities are to be achieved, and these grain types are also preferred from the view of pressure resistance. When the silver halide grains have a structure as described above, the boundary between the portions with different halogen compositions may be a distinct boundary or may be an indistinct boundary in which mixed crystals are formed due to the difference in composition, or alternatively, the boundry may be one in which there are positively continuous structural changes.

Any silver bromide/ silver chloride ratio may be used, as required, for the halogen composition of the silver chlorobromide emulsion. This ratio can vary over a wide range in accordance with the intended purpose, and a silver chloride percentage of 2 mol % or more is preferred.

Furthermore, high silver chloride content emulsions may be used in the present invention when the photosensitive material is intended for rapid processing. The silver chloride content of the high silver chloride content emulsion is preferably 90 mol % or more, and more preferably 95 mol % or more.

With such high silver chloride content emulsions, those structures having a localized silver bromide phase on the inside and/or the surface of the silver halide grain in laminar or non-laminar form as described above is preferably used. The silver bromide content in the halogen composition in the above noted localized phase is preferably at least 10 mol %, and more preferably at least 20 mol %. These localized phases may be present on the inside of the grain, on the edges or corners of the surface of the grain, or on the grain surfaces. Epitaxial growth on the corners of the grain is preferred.

In order to minimize the sensitivity reduction which occurs when the photosensitive material is subjected to applied pressure, it is preferable to use uniform structure grains having little difference in the halogen composition distribution within the grain, even with high silver chloride content emulsions having a silver chloride content of 90 mol % or more.

Furthermore, in order to reduce the amount of development processing solution replenishment, the silver chloride content of the silver halide emulsion may be further increased. In such cases, it is preferable to use an almost pure silver chloride emulsion having a silver chloride content of 98 mol % to 100 mol %.

The average grain size of the silver halide grains contained in the silver halide emulsion of the present invention (the numerical average taking the diameter of the circle equivalent to the projected surface area of the grain to be the grain size), is preferably 0.1 μm to 2 μm.

Furthermore, as regarding the grain size distribution, monodisperse grains having a variation coefficient (the standard deviation in the grain size distribution divided by the average grain size) of 20% or less and preferably 15% or less are used. It is preferable to carry out multilayer coating and to use the above noted monodisperse emulsions by blending various emulsions into the same layer in order to obtain a wide latitude.

The silver halide grains contained in the photographic emulsion of the present invention may have a cubic, tetradecahedral, octahedral or other such regular crystal form, or a spherical, tabular or other such irregular crystal form or those a complex form of these structures. Furthermore, the emulsion may consist of mixtures of grains having various crystal forms. In this invention, emulsions containing 50% or more, preferably 70% or more and most preferably 90% or more of grains having a regular crystal form as described above are preferred.

Furthermore, apart from these, emulsions of tabular grains having an average aspect ratio (circle-calculated diameter/thickness) of 5 or more and preferably 8 or more constitute more than 50% of all the grains by projected surface area.

The silver chlorobromide emulsion for use in the present invention can be prepared using the methods disclosed, for example, in *Chimie et Physique Photoorapphique* by P. Glafkides (published by Paul Montel, 1967), *Photographic Emulsion Chemistry* by G. F. Duffin (published by the Focal Press, 1966) and *Making and Coating Photoqraphic Emulsion* by V. L. Zelikman et al. (published by the Focal Press, 1964). Thus, the acidic method, neutral method, ammonia method and the like may all be used, and for reacting the soluble silver salts and soluble halogen salts, any known method may be used such as the single jet method, double jet method or a combination of these methods. The method wherein the grains are formed in the presence of an excess of silver ions (the so-called reverse mixing method), may also be used. With respect to the double jet method, the method wherein the pAg in the liquid phase in which the silver halide is produced is kept constant, in other words the so-called controlled double jet method, may be used. This method provides silver halide emulsions having a regular grain form and a grain size close to uniform.

With the silver halide emulsion for use in the present invention, various polyvalent metal ion additives can be introduced during the emulsion grain formation or physical ripening stage. Examples of useful metal ion additives include salts of cadmium, zinc, lead, copper and thallium and salts or complex salts of Group VIII (of the Periodic Table) elements such as iron, ruthenium, rhodium, palladium, osmium, iridium and platinum. In particular, preference is given to the use of the above notned Group VIII elements. The addition amount of the metal ions depends on the intended use thereof, but is preferably introduced in an amount of from $10^{-9}$ to $10^{-2}$ mole per mol of the silver halide.

The silver halide emulsions for use in the present invention is generally chemically and spectrally sensitized.

Chemical sensitization suitable for use in the present invention include either singly or in combination, sulfur sensitization, as typified by the addition of unstable sulfur compounds, precious metal sensitization as typified by gold sensitization, or reduction sensitization. As regards the compounds used for chemical sensitization, preference is given to those described in JP-A-62-215272, at the lower right column at page 18 to the upper right column at page 22.

Spectral sensitization is carried out in order to spectrally sensitize the photosensitive silver halide emulsion layers in the required light wavelength region. In the present invention, it is preferable to add dyes which absorb light in a wavelength region corresponding to the intended spectral sensitivity, i.e. spectrally sensitizing dyes. Useful spectrally sensitizing dyes include those dyes described in *Heterocyclic Compounds—Cyanine Dyes And Related Cmpounds* by F. M. Harmer, published by John Wiley & Sons, New York and London, 1964. Preference is given to use of the exemplary compounds described in the specification of previously cited JP-A-62-215272 in the upper right column of page 22 to page 38.

It is possible to add various compounds or precursors thereof to the silver halide emulsion for use in the present invention in order to prevent fogging or to stabilize the photographic performance during the production, storage or photographic processing of the photosensitive material. These are generally referred to as photographic stabilizers. Preference is given to the use of the exemplary compounds described in the previously cited JP-A-62-215272, at page 39 to page 72.

The silver halide emulsions for use in the present invention may be a surface latent image emulsion in which the latent image forms mainly on the surface of the grain, or an internal latent image emulsion in which the latent image forms mainly on the inside of the grain.

When the present invention is applied to color photosensitive materials, the color photosensitive material, generally contains yellow couplers, magenta couplers and cyan couplers which form yellow, magenta and cyan, respectively, upon coupling with the oxidation product of an aromatic amine color developing agent.

The cyan couplers, magenta couplers and yellow couplers which are preferably used in the present invention include those represented by the following general formulae (C-I), (C-II), (M-I), (M-II) and (Y).

General formula (C-I)

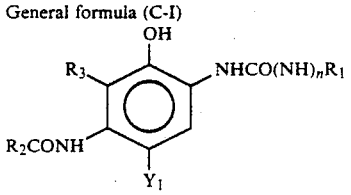

General formula (C-II)

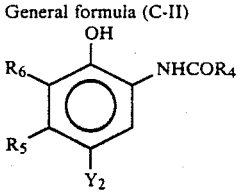

General formula (M-I)

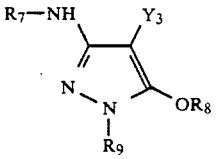

General formula (M-II)

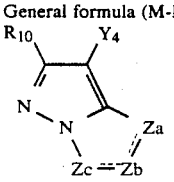

General formula (Y)

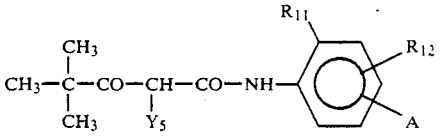

In general formulae (C-I) and (C-II), $R_1$, $R_2$ and $R_4$ each represent a substituted or unsubstituted aliphatic group, aromatic group or heterocyclic group, $R_3$, $R_5$ and $R_6$ each represents a hydrogen atom, halogen atom, aliphatic group, aromatic group or acylamino group, and $R_3$ may also represent a group of non-metal atoms which forms a nitrogen-containing 5-membered ring or 6-membered ring together with $R_2$. $Y_1$ and $Y_2$ each represenst a hydrogen atom or a group which is released upon coupling with the oxidized product of the developing agent. n represents 0 or 1.

The following are preferred as examples of cyan couplers represented by the above noted general formulae (C-I) or (C-II).

The preferred $R_1$ in general formula (C-I) is an aryl group or heterocyclic group, and further preference is given when $R_1$ is an aryl group substituted with a halogen atom, alkyl group, alkoxy group, aryloxy group, acylamino group, acyl group, carbamoyl group, sulfonamido group, sulfamoyl group, sulfonyl group, sulfamido group, oxycarbonyl group or cyano group.

In general formula (C-I), when $R_3$ and $R_2$ do not form a ring, $R_2$ is preferably a substituted or unsubstituted alkyl group or aryl group, and particularly preferably an alkyl group substituted with a substituted aryloxy group, while $R_3$ is preferably a hydrogen atom.

The preferred $R_4$ in general formula (C-II) is a substituted or unsubstituted alkyl group or aryl group, and particularly preferably an alkyl group substituted with a substituted aryloxy group.

The preferred $R_5$ in general formula (C-II) is an alkyl group having 2–15 carbon atoms and a methyl group having a substituent group with one or more carbon atoms, preferable substituent groups being the arylthio group, alkylthio group, acylamino group, aryloxy group and alkyloxy group.

In general formula (C-II), $R_5$ is more preferably an alkyl group having 2–15 carbon atoms, and it is particularly preferably an alkyl group having 2–4 carbon atoms. In general formula (C-II), aliphatic groups are preferred for $R_5$, examples of which include a methyl group, ethyl group, propyl group, butyl group, pentadecyl group, tert-butyl group, cyclohexyl group, cyclohexylmethyl group, phenylthiomethyl group, dodecyloxyphenylthiomethyl group, butanamidomethyl group and methoxymethyl group.

The $R_6$ which is preferred in general formula (C-II) is a hydrogen atom or a halogen atom, and the chlorine atom and fluorine atom are particularly preferred.

The $Y_1$ and $Y_2$ which are preferred in general formulae (C-I) and (C-II) are respectively the hydrogen atom, halogen atom, alkoxy group, aryloxy group, acyloxy group and sulfonamido group.

In general formula (M-I), $R_7$ and $R_9$ each represent an aryl group, $R_8$ represents a hydrogen atom, aliphatic or aromatic acyl group or aliphatic or aromatic sulfonyl group, and $Y_3$ represents a hydrogen atom or a splitting group. Substituent groups for the aryl group (preferably the phenyl group) for $R_7$ and $R_9$ are the same as those for substituent group $R_1$ and, when there are 2 or more substituent groups, the substituent groups may be the same or different. $R_8$ is preferably a hydrogen atom, aliphatic acyl group or sulfonyl group, and it is particularly preferably a hydrogen atom. $Y_3$ is preferably a splitting group including a sulfur, oxygen or nitrogen atom and, by way of example, particular preference is given to the sulfur atom type splitting group described in U.S. Pat. No. 4,351,897 and International Disclosure WO 88/04795.

In general formula (M-II), $R_{10}$ represents a hydrogen atom or splitting group. $Y_4$ represents a hydrogen atom or splitting group, and particular preference is given to halogen atoms and the arylthio group. Za, Zb and Zc represent methine, substituted methine, =N— or —NH—, wherein one of the Za-Zb bond or Zb-Zc bond is a double bond and the other a single bond. When the Zb-Zc bond is a carbon-carbon double bond, this group may be part of an aromatic ring. In cases in which a dimer or higher polymer is formed by $R_{10}$ or $Y_4$, and when Za, Zb or Zc is a substituted methine, include cases in which a dimer or higher polymer is formed by the substituted methine.

Of the pyrazoloazole-based couplers represented by general formula (M-II), preference is given to the imidazo-[1,2-b]pyrazoles described in U.S. Pat. No. 4,500,630, and particular preference is given to the pyrazolo[1,5-b][1,2,4]-triazole described in U.S. Pat. No. 4,540,654 due to the small amount of yellow side absorption by the chromogenic dye, and due to the fastness to light.

In addition, preference is given to the use of the pyrazolotriazole coupler in which a branched alkyl group has been directly bonded to the 2-, 3- or 6-position of the pyrazolotriazole ring as described in JP-A-61-65245, the pyrazoloazole couplers which contain sulfonamido groups as described in JP-A-61-65246, the pyrazoloazole couplers having alkoxyphenylsulfonamido ballast groups as described in JP-A-61-147254 and the pyrazolotriazole couplers having an alkoxy group or aryloxy group in the 6-position as described in European Patents (laid open) 226,849 and 294,785.

In general formula (Y), $R_{11}$ represents a halogen atom, alkoxy group, trifluoromethyl group or aryl group, and $R_{12}$ represents a hydrogen atom, halogen atom or alkoxy group. A represents $—NHCOR_{13}$, $—NHSO_2—R_{13}$, $—SO_2NHR_{13}$, $—COOR_{13}$ or $$—SO_2\underset{\underset{R_{14}}{|}}{N}—R_{13}$$

where $R_{13}$ and $R_{14}$ each represents an alkyl group, aryl group or acyl group. $Y_5$ represents a splitting group. The substituent groups for $R_{14}$, $R_{13}$ and $R_{12}$ are the same as those for $R_1$, and the splitting group $Y_5$ is preferably a splitting group including an oxygen atom or nitrogen atom, the nitrogen atom splitting type being particularly preferred.

Useful examples of couplers represented by general formula (C-I), (C-II), (M-I), (M-II) and (Y) are listed below.

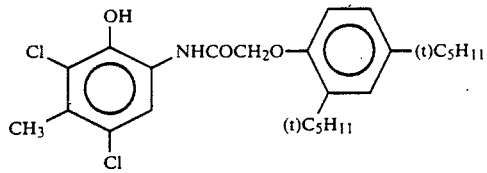

(C-1)

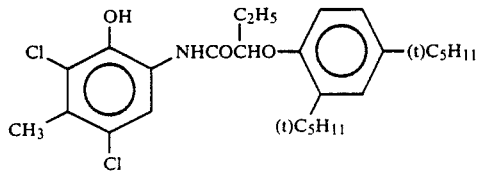

(C-2)

-continued
(C-3)
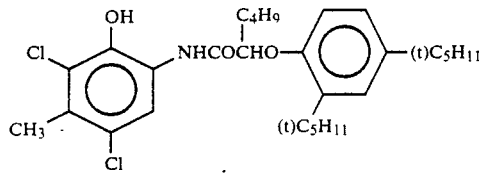
(C-4)
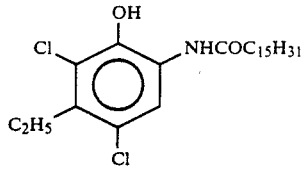
(C-5)
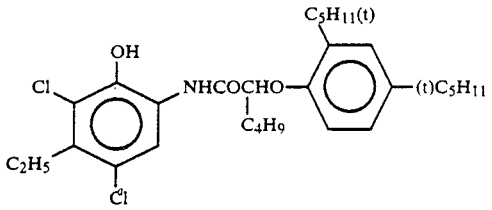
(C-6)
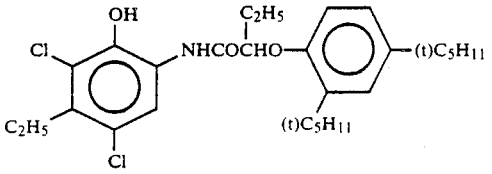
(C-7)
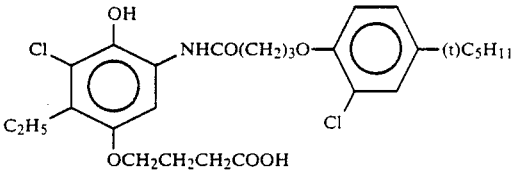
(C-8)
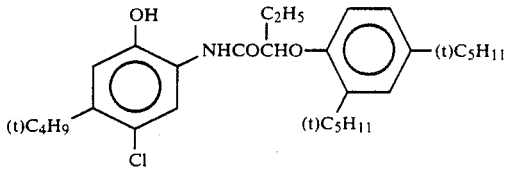
(C-9)
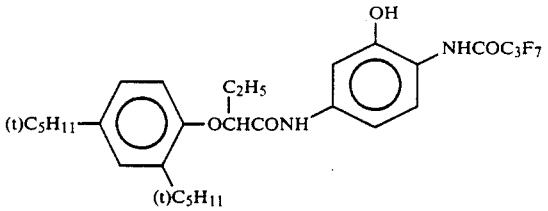
(C-10)
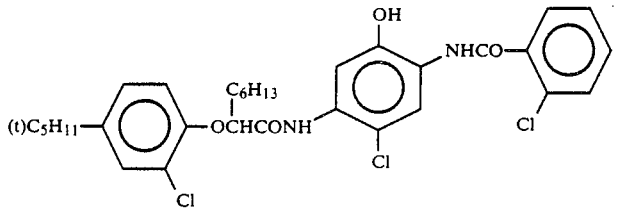

-continued
(C-11)
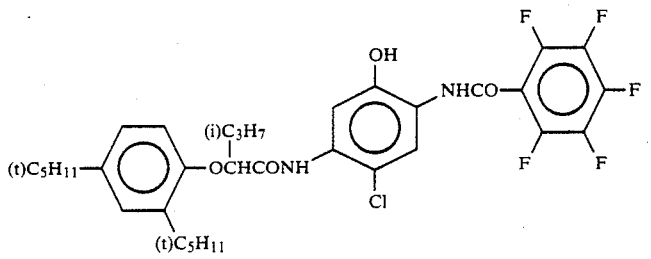
(C-12)
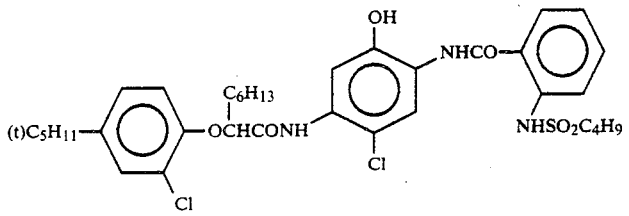
(C-13)
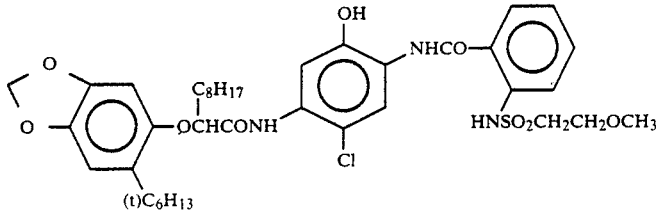
(C-14)
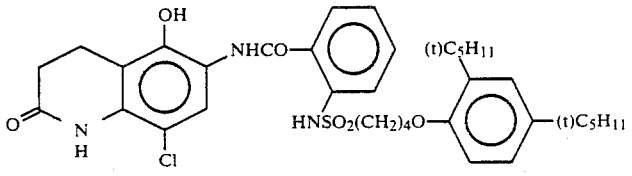
(C-15)
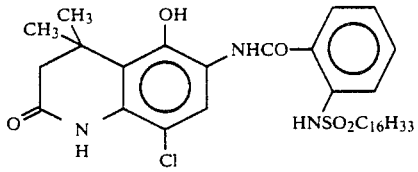
(C-16)
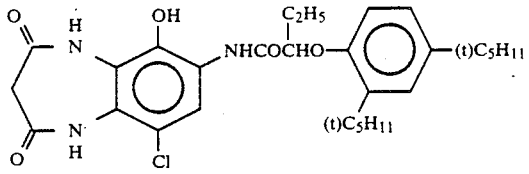
(C-17)
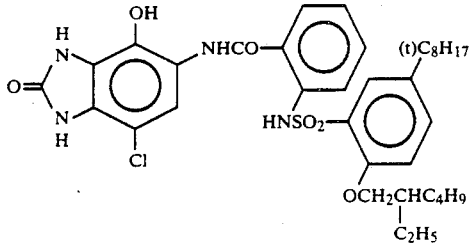

-continued
(C-18)
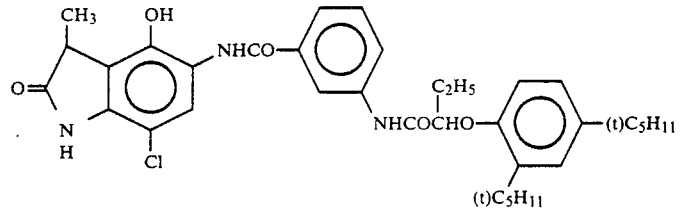
(C-19)
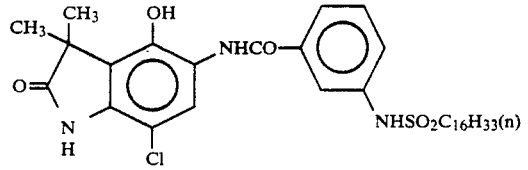
(C-20)
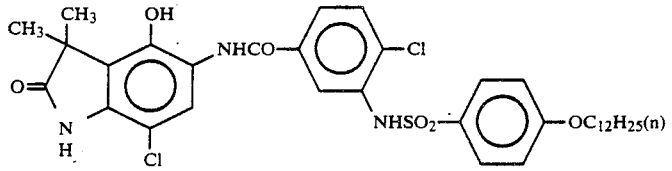
(C-21)
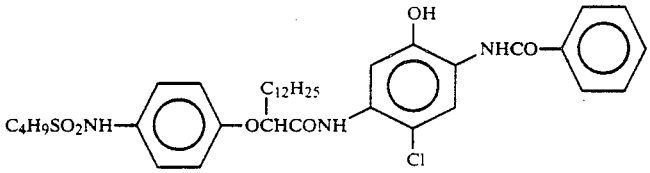
(C-22)
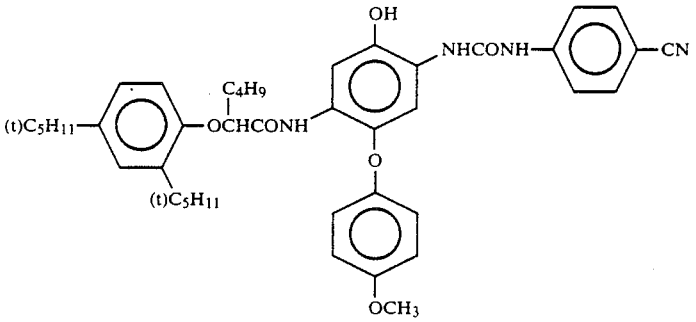
(M-1)
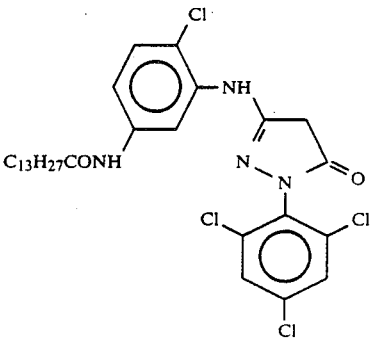

-continued
(M-2)
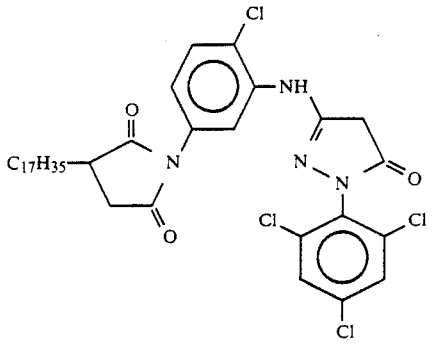
(M-3)
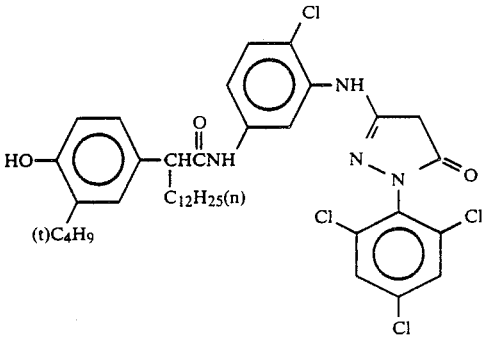
(M-4)
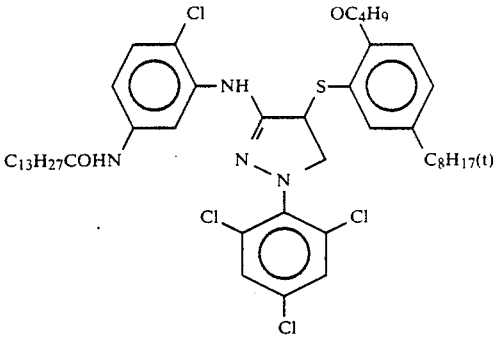
(M-5)
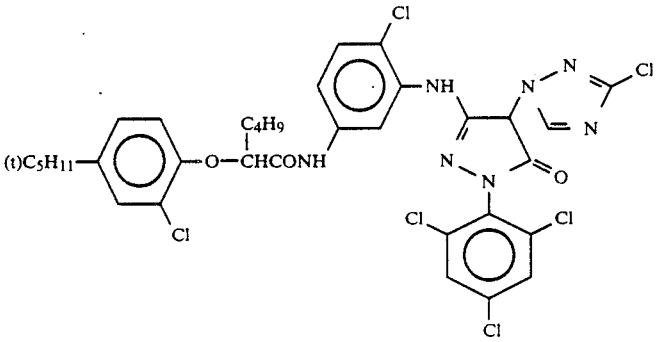

-continued
(M-6)
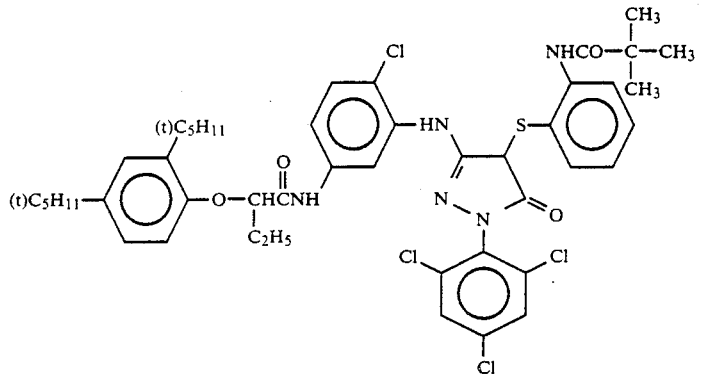
(M-7)
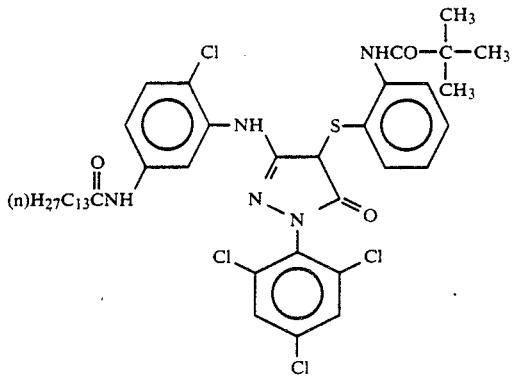
(M-8)
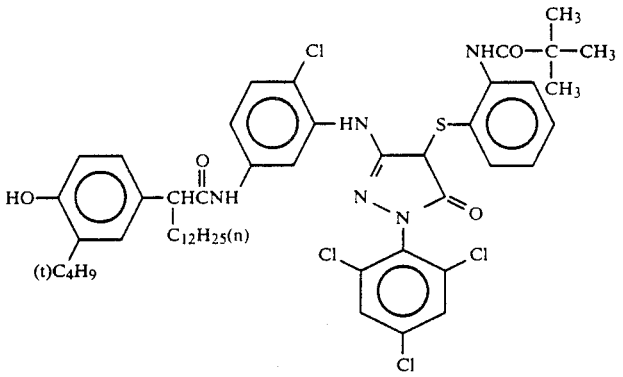
| COMPOUND | $R_{10}$ | $R_{15}$ | $Y_4$ |
|---|---|---|---|
| | | 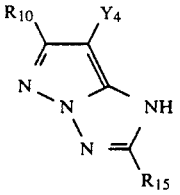 | |
| M-9 | $CH_3$— | 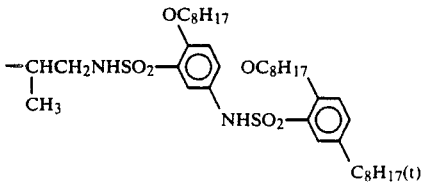 | Cl |

-continued
| COMPOUND | $R_{10}$ | $R_{15}$ | $Y_4$ |
|---|---|---|---|
| M-10 | As above | 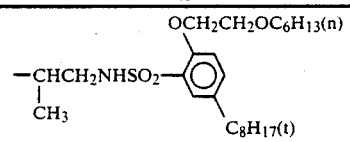 | As above |
| M-11 | $(CH_3)_3C-$ | 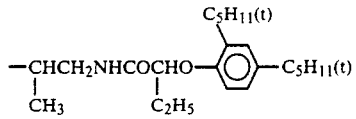 | 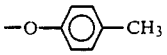 |
| M-12 | 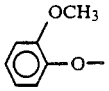 | 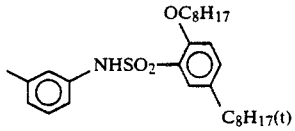 | 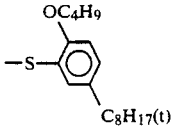 |
| M-13 | $CH_3-$ | 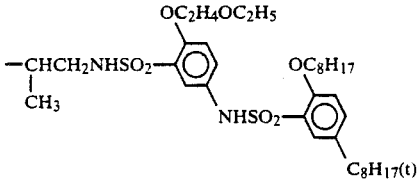 | Cl |
| M-14 | As above | 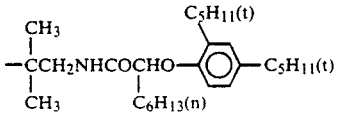 | As above |
| M-15 | As above | 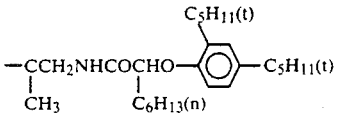 | As above |
| M-16 | $CH_3-$ | 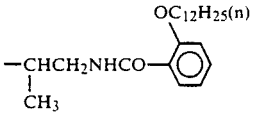 | Cl |
| M-17 | As above | 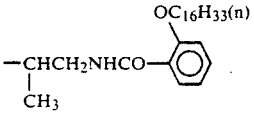 | As above |
| M-18 | 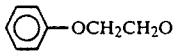 | 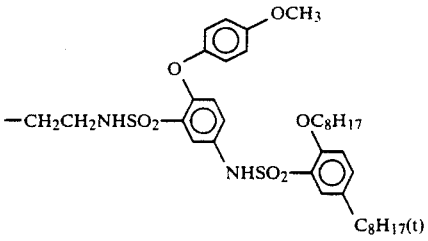 | 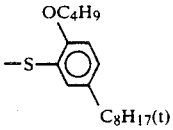 |
| M-19 | $CH_3CH_2O-$ | As above | As above |
| M-20 | 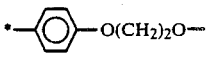 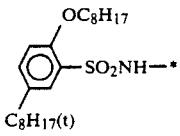 | 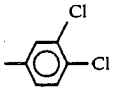 | 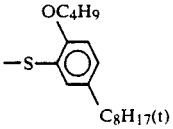 |

-continued
| COMPOUND | $R_{10}$ | $R_{15}$ | $Y_4$ |
|---|---|---|---|
| M-21 | 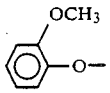 | 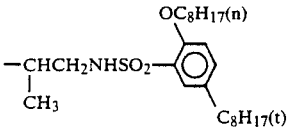 | Cl |
| Compound | $R_{10}$ | $R_{15}$ | $Y_4$ |
| | | 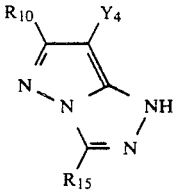 | |
| M-22 | $CH_3$— | 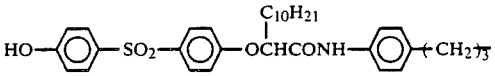 | Cl |
| M-23 | As above | 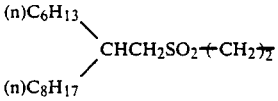 | As above |
| M-24 | 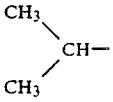 | 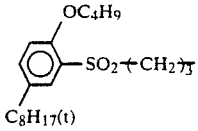 | As above |
| M-25 | 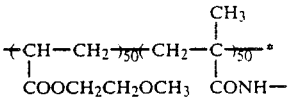 | 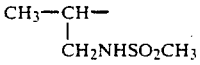 | As above |
| M-26 | 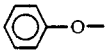 | 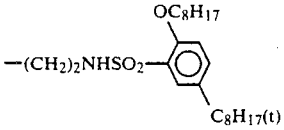 | Cl |
| M-27 | $CH_3$— | 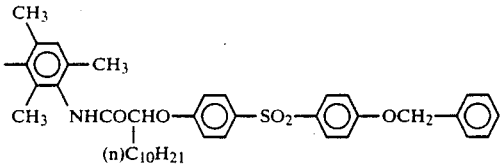 | As above |
| M-28 | $(CH_3)_3C$— | 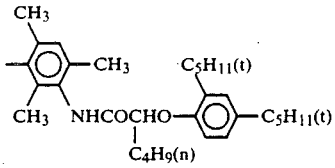 | As above |
| M-29 | 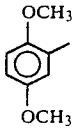 | 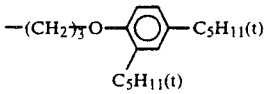 | Cl |

-continued
| COMPOUND | $R_{10}$ | $R_{15}$ | $Y_4$ |
|---|---|---|---|
| M-30 | $CH_3$— | $-CH(C_2H_5)-N(n\text{-}C_{18}H_{37})COCH_2CH_2COOH$ | As above |
*The suffixes of parenthesis show a weight ratio.
(Y-1)
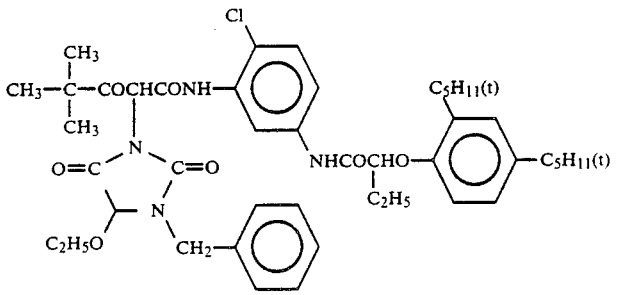
(Y-2)
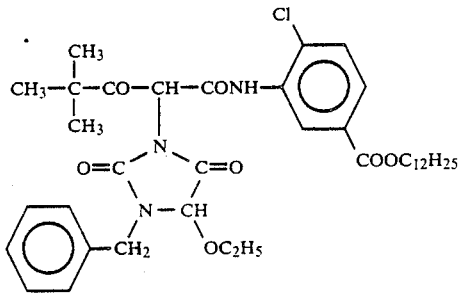
(Y-3)
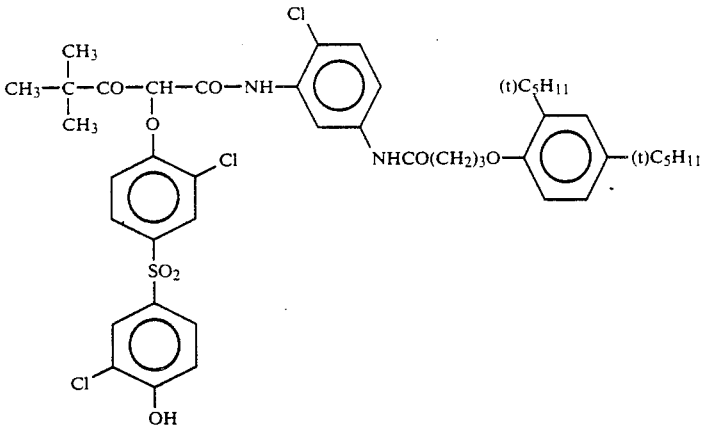
(Y-4)
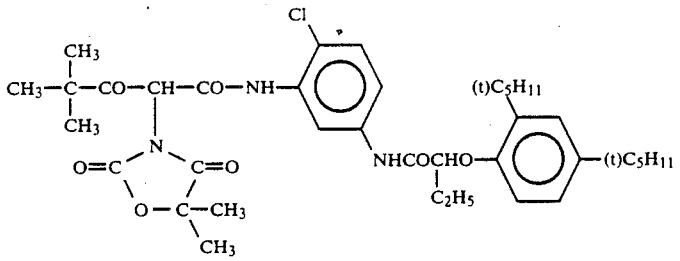

-continued (Y-5)

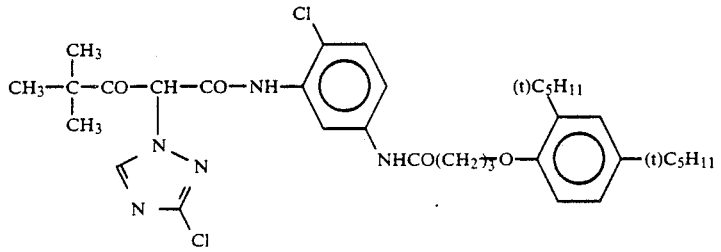

(Y-6)

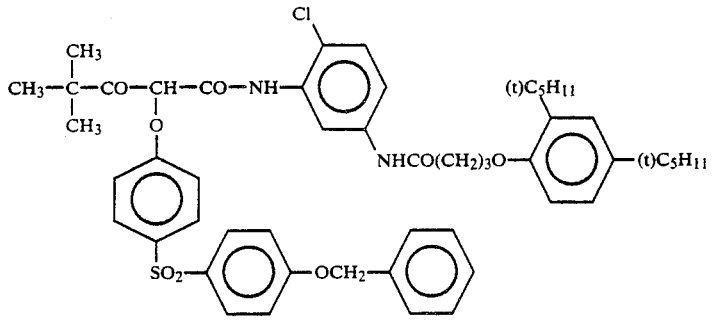

(Y-7)

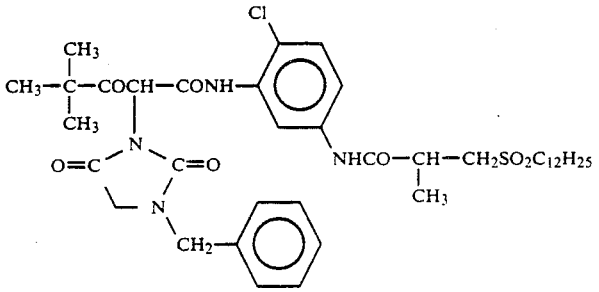

(Y-8)

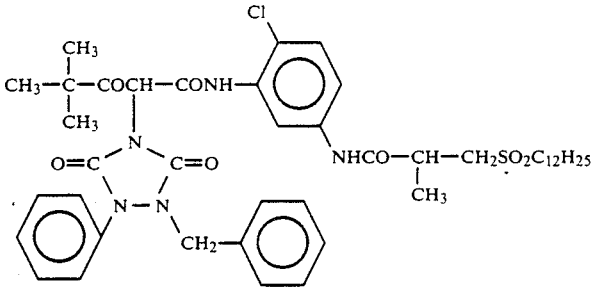

(Y-9)

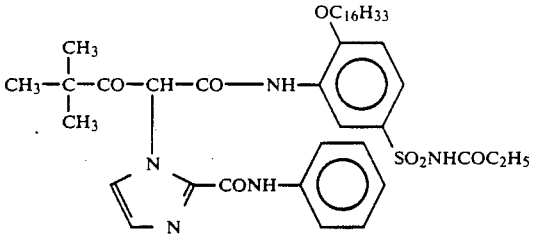

The couplers represented by the above noted general formulae (C-I) to (Y) are generally included in the silver halide emulsion layers in an amount of from 0.1 to 1.0 mole, and preferably at 0.1 to 0.5 mole per mole of silver halide.

In the present invention, various known techniques can be applied to the addition of the above noted couplers to the photosensitive layers. By way of an oil protect method, the couplers can be added by a known oil-in-water dispersion method, such that the couplers are emulsified and dispersed in an aqueous gelatin solution containing a surfactant after having been dissolved in a solvent. Alternatively, water or an aqueous gelatin solution may be added to a coupler solution containing surfactants to make an oil-in-water dispersion with phase inversion. Additionally, alkali-soluble couplers can also be dispersed by the so-called Fischer dispersion process After having removed the low-boiling organic solvents from the coupler dispersion by distillation, noodle washing, ultrafiltration or a similar process, the coupler dispersion may then be mixed with the photographic emulsion.

It is preferable to use a high-boiling organic solvent and/or a water-insoluble high polymeric compound with a dielectric constant of 2 to 20 (25° C.) and a refractive index of 1.5 to 1.7 (25° C.) as the coupler dispersant.

High-boiling organic solvents represented by the following general formulae (A)-(E) are preferably used as the high-boiling organic solvent.

General formula (A)

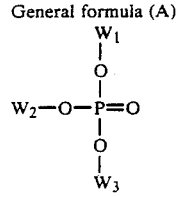

General formula (B)

$W_1—COO—W_2$

General formula (C)

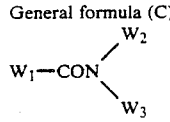

General formula (D)

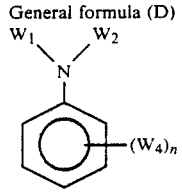

General formula (E)

$W_1—O—W_2$

In the above noted formulae, $W_1$, $W_2$ and $W_3$ each represents a substituted or unsubstituted alkyl group, cycloalkyl group, alkenyl group, aryl group or heterocyclic group, $W_4$ represents $W_1$, $OW_1$ or $S-W_1$, n is an integer of from 1 to 5 and, when n is 2 or more, the $W_4$ groups may be the same or different, and, in general formula (E), $W_1$ and $W_2$ may form a condensed ring.

High-boiling organic solvents for use in the present invention also include those compounds outside the scope of general formulae (A) to (E) which are not miscible with water and have a melting point of 100° C. or less and a boiling point of 140° C. or more which also constitutes a good solvent for the couplers. The melting point of the high-boiling organic solvent is preferably 80° C. or less. The boiling point of the high-boiling organic solvent is preferably 160° C. or higher and more preferably 170° C. or higher.

Details concerning these high-boiling organic solvents are given in JP-A-62-215272, at the lower right column of page 137 to the upper right column of page 144.

Furthermore, the couplers for use in the present invention can be emulsified and dispersed in aqueous hydrophilic colloid solutions by dissolving the couplers in a polymer which is insoluble in water but soluble in organic solvents, or by impregnating the couplers into a loadable latex polymer (see U.S. Pat. No. 4,203,716) with or without the presence of the above noted high-boiling organic solvents.

The homopolymers or copolymers described in the specification of the International Disclosure WO 88/00723, pages 12 to 30 are preferably used, and the use of an acrylamide-based polymer is particularly preferred from the standpoint of color image stabilization and the like.

The photosensitive materials of the present invention may contain hydroquinone derivatives, aminophenol derivatives, gallic acid derivatives, ascorbic acid derivatives and the like as color fogging prevention agents.

Various color fading prevention agents can be used in the photosensitive material of the present invention. Useful examples of organic color fading preventors for cyan, magenta and/or yellow images include hydroquinones, 6-hydroxychromans, 5-hydroxycoumarans, spirochromans, p-alkoxyphenols, bisphenols and various other hindered phenols, gallic acid derivatives, methylenedioxybenzenes, aminophenols, hindered amines and ether or ester derivatives of these compounds in which the phenolic hydroxyl group has been silylated or alkylated. Furthermore, metal complexes such as the (bissalicylaldoximato)nickel complex and (bis-N,N-dialkyldithiocarbamato) nickel complex may be used.

Useful examples of organic color-fading prevention agent are described in the following patents.

Hydroquinones are described in U.S. Pat. Nos. 2,360,290, 2,418,613, 2,700,453, 2,701,197, 2,728,659, 2,732,300, 2,735,765, 3,982,944, 4,430,425, G.B. Patent 1,363,921, U.S. Pat. No. 2,710,801 and 2,816,208, 6-hydroxychromans, 5-hydroxycoumarans and spriochromans are described for example, in U.S. Pat. Nos. 3,432,300, 3,573,050, 3,574,627, 3,698,909, 3,764,337 and JP-A-52-152225, spiroindans are described in U.S. Pat. No. 4,360,589, p-alkoxyphenols are described, for example, in U.S. Pat. No. 2,735,765, G.B. Patent 2,066,975, JP-A-59-10539, JP-B-57-19765, hindered phenols are described, for example, in U.S. Pat. No. 3,700,455, JP-A-52-72224, U.S. Pat. No. 4,228,235 and JP-B-52-6623; gallic acid derivatives, methylenedioxybenzenes and aminophenols are respectively described, for example, in U.S. Pat. Nos. 3,457,079, 4,332,886 and JP-B-56-21144, hindered amines are described, for example, in U.S. Pat. Nos. 3,336,135, 4,268,593, G.B. Patents 1,326,889, 1,354,313, 1,410,846, JP-B-51-1420, JP-A-58-114036, JP-A-59-53846, JP-A-59-78344, and metal complexes are described, for example, in U.S. Pat. Nos. 4,050,938, 4,241,155 and G.B. Patent 2,027,731(A). The effect of the above metal compounds is achieved by adding the same to the photosensitive silver halide emulsion layer generally in an amount of from 5 to 100% by weight with regard to the respective color couplers, and emulsifying the couplers together with the couplers. In order to prevent degradation of the cyan image by heat and, in particular, light, it is more effective to introduce ultra-violet absorbers in the cyan-forming layer and in the layers on either side thereof.

Ultraviolet absorbers for use in the present invention include, for example, benzotriazole compounds substituted with an aryl group as described, for example, in U.S. Pat. No. 3,533,794, 4-thiazolidone compounds as described, for example, in U.S. Pat. Nos. 3,314,794 and 3,352,681, benzophenone compounds as described, for example, in JP-A-46-2784, cinnamic acid ester compounds as described, for example, in U.S. Pat. Nos. 3,705,805 and 3,707,395, butadiene compounds as described, for example, in U.S. Pat. No. 4,045,229 or benzooxydol compounds as described, for example, in U.S. Pat. No. 3,700,455. Ultraviolet-absorbing couplers, for example, α-naphthol cyan dye forming couplers, and ultraviolet-absorbing polymers and the like may also be used. These ultraviolet absorbers may be mordanted in specific layers.

Of these, the above noted benzotriazole compounds substituted with an aryl group are preferred.

Furthermore, it is particularly preferable to use the compounds (f) and (G) below together with the above noted couplers. Use of the compounds (F) and (G) with pyrazoloazole couplers is particularly preferred.

Thus, preference is given to the use of the compound (F) which produces chemically inert and essentially colorless compounds by chemically bonding with any aromatic amine developing agent which remains after the color development process and/or a compound (G) which produces chemically inert and essentially colorless compounds by chemically bonding with the oxidized product of an aromatic amine color developing agent which remains after the color development processing. The compounds (F) and (G) prevent the occurrence of staining and other side-effects which can occur during storage after processing due to the formation of chromogenic dyes by a reaction of a coupler with color developing agents or the oxidized products thereof which remain within the film.

As compound (F), preference is given to compounds which react with p-anisidine with a second order reaction rate constant $k_2$ (80° C., in trioctyl phosphate) in the range of from 1.0 1/mol.sec to $1\times10^{-5}$ 1/mol.sec. The second order reaction rate constant can be measured by the method described in JP-A-63-158545.

In the case where $k_2$ has a value greater than the aabove noted range, the compound itself becomes unstable, and decomposes by reaction with gelatin or water. On the other hand, if $k_2$ has a value lower than the above noted range, the reaction with the residual aromatic amine developing agents is slow, and as a result, the side-effects of the residual aromatic amine developing agents is not prevented.

The compounds (F) which meet the above criteria are represented by the following general formulae (FI) and (FII).

General Formula (FI)

$$R_1-(A)_n-X$$

General Formula (FII)

$$R_2-\underset{\underset{B}{|}}{C}=Y$$

In the above formulae, $R_1$ and $R_2$ each represent an aliphatic group, an aromatic group, or a heterocyclic group. n is 1 or 0. A represents a group which reacts with aromatic amine developing agents to form a chemical bond therebetween and X represents a splitting group which reacts with an aromatic amine developing agent. B represents a hydrogen atom, an aliphatic group, aromatic group, heterocyclic group, acyl group, or a sulfonyl group; Y represents a group which promotes the addition of aromatic amine developing agent to a compound of general formula (FII). Here $R_1$ and X, Y and $R_2$ or B can bond to form a ring structure.

Substitution reactions and addition reactions are representative of the chemical bonding which can take place with a residual primary aromatic amine developing agent.

Preferred specific examples of the compounds represented by general formulae (FI) and (FII) are disclosed in JP-A-63-158545, JP-A-62-283338, and European Laid-Open Patents 298,321, 277,589, etc.

Compounds represented by the following general formula (GI) are more preferred among of the compound (G) which produces chemically inert and colorless compounds by chemically bonding with the oxidized product of an aromatic amine developing agent which remain after the color development processing.

General Formula (GI)

$$R-Z$$

In the above formula, R represents an aliphatic group, aromatic group or heterocyclic group. Z is a nucleophilic group or a group which decomposes within the photosensitive material to release a nucleophilic group. Z in the compound represented by general formula (GI) is preferably a group having a Pearson nucleophilicity $^{n}CH_3I$ value (R. G. Pearson et al., *J. Am. Chem. Soc.*, 90, 319 (1968)) of 5 or more, or a group derived from such a group.

Preferred specific examples of the compounds represented by general formula (GI) are those disclosed in European Patent (Laid-Open) 255,722, JP-A-62-143048, JP-A-62-229145, Japanese Patent Applications No. 63-136724, 62-214681 and European Patents (Laid-Open) 298,321 and 277,589.

Furthermore, details of a combination of the above described compound (G) and compound (F) are described in European Patent (Laid-Open) 277,589.

The photosensitive materials produced using this invention may contain water-soluble dyes as filter dyes in hydrophilic colloid layers or for various purposes such as irradiation prevention. Such dyes include oxonol dyes, hemioxanol dyes, styryl dyes, merocyanine dyes, cyanine dyes and azo dyes. Of these, the oxonol dyes, hemioxanol dyes and merocyanine dyes are useful.

By way of example, the silver halide photosensitive material of the present invention may comprises the following structural arrangements.

(1) Support/bonding layer (subbing layer)-/YL/ML/GL/ML/CL/PcL
(2) Support/bonding layer (subbing layer)-/YL/ML/CL/ML/GL/ML/PcL
(3) Support/bonding layer (subbing layer)/CL/ML/GL/ML/YL/ML/PcL
(4) Support/bonding layer (subbing layer)/CL/ML/GL/Ml/FL/YL/ML/PcL
(5) Support/bonding layer (subbing layer)/CL/ML/FL/GL/FL/YL/ML/PcL
(6) Support/bonding layer (subbing layer)/FL/CL/ML/FL/GL/FL/YL/ML/PcL·
(7) Support/bonding layer (subbing layer)/GL/ML/YL/ML/CL/ML/PcL
(8) Support/bonding layer (subbing layer)-/YL/ML/GL/FL/CL/ML/PcL
(9) Support/bonding layer (subbing layer)-/YL/FL/GL/FL/CL/ML/PcL Here, YL is a photosensitive layer containing a yellow coupler GL is a photosensitive layer containing a magenta coupler CL is a photosensitive layer containing a cyan coupler ML is an intermediate layer PcL is a protective layer FL is a filter layer or a donor layer with an interlayer effect ( ) indicates that the subject layer may be provided as required. Furthermore, each photosensitive layer may comprise 2 layers or 3 layers.

The color developing solutions for use in the development processing of the photosensitive materials of the present invention are preferably aqueous alkaline solutions which have primary aromatic amine color developing agents as their main constituents. Aminophenol compounds are useful as such color developing agents, but p-phenylenediamine compounds are preferred and representative examples of these include 3-methyl-4-amino-N,N-diethylaniline,3-methyl-4-amino-N-ethyl-N-β-hydroxyethylaniline, 3-methyl-4-amino-N-ethyl-N-β-methanesulfonamidoethylaniline and 3-methyl-4-amino-N-ethyl-N-β-methoxyethylaniline as well as the sulfuric acid salts, hydrochloric acid salts and p-toluenesulfonic acid salts thereof. Two or more of these compounds may be used together as required.

The color developing solution generally contains pH buffers such as alkali metal carbonates or phosphates, antifoggants or development inhibitors such as bromides, iodides, benzimidazoles, benzothiozoles or mercapto compounds. Furthermore, as required, the developing solution may contain hydroxylamine, diethylhydroxylamine, sulfites, hydrazines such as N,N-biscarboxymethylhydrazine, phenylsemicarbazides, triethanolamine, catecholsulfonates and various other such preservatives, organic solvents such as ethylene glycol and diethylene glycol, development accelerators such as benzyl alcohol, polyethylene glycol, quaternary ammonium salts and amines, color-forming couplers, competitive couplers, 1-phenyl-3-pyrazolidone and other such auxiliary developing agents, viscosity-imparting agents and various chelating agents as typified by aminopolycarboxylic acid, aminopolyphosphonic acid, alkylphosphonic acid and phosphonocarboxylic acid; examples thereof including ethylenediaminetetraacetic acid, nitrilotriacetic acid, ethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof.

When carrying out reversal processing, color development is usually performed after effecting a black-and-white development and reversal processing. The black-and-white development solution may comprise either alone or in combination, known black-and-white developing agents including a dihydroxybenzene such as hydroquinone, a 3-pyrazolidone such as 1-phenyl-3-pyrazolidone or an aminophenol such as N-methyl-p-aminophenol.

The pH of the color developing solution and black-and-white developing solution is generally 9–12. Furthermore, while the replenishment amount for these developing solutions in part depends upon the color photosensitive materials being processed, it will generally be 3 liters or less per square meter of the photosensitive material, and if the bromide ion concentration in the replenishment solution is reduced, the replenishment amount can be 500 ml or less. In cases where the replenishment amount has been reduced, it is preferable to prevent evaporation and aerial oxidation of the solution by limiting the surface area in contact with the air in the processing bath. The area of contact between the air and the photographic processing solution in the processing bath can be represented as an air-exposure ratio as defined below.

Air-exposure ratio = area of contact of processing solution and air ($cm^2$)/volume of processing solution ($cm^3$)

The above noted air-exposure ratio is preferably 0.1 or less and more preferably 0.001 to 0.05.

Methods of reducing the air-exposure ratio include providing a screen such as a floating lid on the surface of the photographic processing solution in the processing bath, the use of a movable lid as described in JP-A-64-82033, and the slit development processing method described in JP-A-63-216050.

The reduction in the air-exposure ratio applies not only to the color development and black-and-white development stages, but preferably also to all of the various subsequent stages such as bleaching, bleach-fixing, fixing, washing and stabilization. Furthermore, the replenishment amount may be reduced by using a technique which inhibits the build-up of bromide ion in the development solution.

A peiod of 2 to 5 minutes is normally provided for the color development processing time, but it is possible to make provision for a further shortening in the processing time by adopting high temperatures and a high pH, and by using a high concentration of color developing agent.

The color photosensitive material of the present invention is generally bleach processed after color development. The bleach processing may be carried out simultaneously with the fixing processing (bleach-fixing processing) or it may be carried out separately. A processing method in which bleach-fixing processing is carried out after a bleaching process may also be adopted in order to provide for even faster processing. Furthermore, as required and as desired, it is possible to effect processing in a bleach-fixing bath with two linked tanks, fixing before the bleach-fixing process or bleaching after the bleach-fixing process. The compounds of polyvalent metals such as iron(III), for example, may be used as the bleaching agent. Useful bleaching agents include organic complex salts of iron(III) such as the complex salts of ethylenediamine tetraacetic acid, diethylenetriaminepentaacetic acid, cyclohexanediaminetetraacetic acid, methylmininodiacetic acid, 1,3-diaminopropanetetraacetic acid, glycol ether diaminetetracetic acid and other such aminopolycarboxylic acids or of citric acid, tartaric acid and malic acid. Of these, preference is given to iron(III) aminopolycarboxylic acid complex salts, notably iron(III) ethyleneidaminetetraacetic acid complex salts and persulfates in view of the rapidity of processing and environmental factors. Moreover, iron(III) aminopolycarboxylic acid complex salts are particularly useful in both bleaching solutions and bleach-fixing solutions. The pH of bleaching solutions or bleach-fixing solutions which make use of these iron(III) aminopolycarboxylic acid complex salts is normally 4.0–8.0, but it is possible to carry out the processing at a lower pH in order to hasten the processing.

Bleaching accelerators can be used in the bleaching solutions and bleach-fixing solutions and pre-baths thereof as required. Examples of useful bleaching accelerators include those described in the following patent publications: the compounds having a mercapto group or disulfide bond described in U.S. Pat. No. 3,893,858, West German Patent 1,290,812, JP-A-53-95630 and *Research Disclosure* No. 17,129 (July 1978); the hiazolidine derivatives described in JP-A-50-140129; the thiourea derivatives described in U.S. Pat. No. 3,706,561; the iodine salts described in JP-A-58-16235; the polyoxyethylene compounds described in West German Patent 2,748,430; the polyamine compounds described in JP-B-45-8836; and bromide ion. Of these, the compounds having a mercapto group or disulfide group are preferred as having a large accelerating effect; particular preference being given to the compounds described in U.S. Pat. No. 3,893,858, West German Patent 1,290,812 and JP-A-53-95630. Furthermore, preference is also given to the compounds described in U.S. Pat. No. 4,552,834. The bleaching accelerators may also be added to the photosensitive material. The bleaching accelerators are particularly effective when effecting bleach-fixing of a color photosensitive material for picture taking.

Useful fixing agents include thiosulfates, thiocyanates, thioether compounds, thioureas and large amounts of iodine salts, thiosulfates being widely used and ammonium thiosulfate in particular being most widely used. Preferred preservatives for the bleach-fixing solution include sulfites and bisulfites, p-toluenesulfinic acid and other such sulfinic acids or carbonyl bisulfite adducts.

The silver halide color photosensitive material of this invention is generally subjected to a washing and/or stabilization step after the desilvering process. The amount of washing water in the washing stage is set over a wide range depending on various conditions such as the properties of the photo-sensitive material (which depend on the partaicular couplers and other materials employed, for example), the application, and on the washing water temperature, the number of washing tanks (the number of stages), the replenishment method such as countercurrent or sequential flow and the like. Of these, the relationship between the number of washing tanks and the amount of water in a multistage countercurrent system can be determined by the method described in the *Journal of the Society of Motion Picture and Television Engineers,* Vol. 64, pp. 248–253 (May 1955).

The amount of washing water can be greatly reduced by the use of a multi-stage countercurrent system as described in the above noted literature, but bacteria tend to propagate due to the increase in the residence time of the water within the tank, and the floating matter accumulated during processing adheres to the photosensitive material. The method for reducing calcium ion and magnesium ion described in JP-A- 62-288838 is extremely effective as a measure for solving this problem in the processing of the color photosensitive materials of the present invention. Furthermore, the isothiazolone compounds and thiabendazoles described in JP-A-57-8542, chlorinated sodium isocyanurate and other such chlorine-containing bactericides, as well as benzotriazole and the bactericides described in "*Bokin Bobai no Kacaku*" (Antibacterial and Antimold Chemistry) by H. Horiguchi (1986, Sankyo Publishing), *Biseibutsu no Genkin, Sakkin, Bobai Gijutsu* (Sterilization, Bactericidal and Antimold Techniques for Microorganisms) edited by the Hygiene Techniques Society (1982, Industrial Techniques Society) and *Bokin Bobaizai Jiten* (Dictionary of Antimicrobial and Antimold Agents) edited by the Antimicrobial and Antimold Society of Japan (1986), may be used.

The pH of the washing water in the processing of the photosensitive material of the present invention is preferably 4–9 and more preferably 5–8. The washing water temperature and washing time is set, for example, depending on the characteristics and application of the photosensitive material, and in general a range of 15°–45° C. over 20 sec.–10 min., preferably 25°–40° C. over 30 sec.–5 min. is selected. Moreover, the photosensitive material of the present invention may be processed using a direct stabilization solution instead of the above noted washing. Any of the known methods described in JP-A-57-8543, JP-A-58-14834 and JP-A-60-220345 may be used for the stabilization processing.

Furthermore, the processing of the photosensitive material of the present invention include further stabilization processing following the washing processing, and an example of this processing include a stabilization bath containing formalin and a surfactant which is used as the final bath for color photosensitive materials for picture taking in accordance with the present invention. It is also possible to add various chelating agents and antimold agents to this stabilization bath.

The overflow from the replenishment of the above noted washing and/or stabilization solutions may be reused in a desilvering stage or other such stage.

A color developing agent may be incorporated into the silver halide color photosensitive material of the present invention in order to simplify and speed-up processing. It is preferable to use a precursor of the color developing agent in the photosensitive material, including, for example, the indoaniline compounds described in U.S. Pat. No. 3,342,597, the Schiff's base compounds described in U.S. Pat. No. 3,342,599 and *Research Disclosures* No. 14,850 and No. 15,159, the aldol compounds described in *Research Disclosure* No. 13,924, the metal complexes described in U.S. Pat. No. 3,719,492 and the urethane compounds described in JP-A-53-135628.

If required, various 1-phenyl-3-pyrazolidones may be incorporated into the silver halide color photosensitive material of the present invention in order to accelerate color development. Useful compounds are described in JP-A-56-64339, JP-A-57-144547 and JP-A-58-115438.

The various processing solutions for use in processing the photosensitive material of the present invention are used preferably at a temperature of from 10° C.–50° C. Generally, a temperature of 33° C.–38° C. is employed, but the processing can be accelerated and the processing time shortened by raising the temperature and, conversely, it is possible to achieve an improvement in the image quality and an improvement in the stability of the processing solution by lowering the temperature. Moreover, processing which makes use of cobalt intensification or hydrogen peroxide intensification as described in West German Patent 2,226,770 or in U.S. Pat. No. 3,674,499 may be carried out in order to economize the silver provided in the photosensitive material.

Preferred embodiments of the present invention are as follows.

(1) A reflective color photosensitive material in which a yellow-forming layer with an R value of 1.0 or less, a magenta-forming layer with an R value of 1.20 or less and a cyan-forming layer with an R value of 1.20 or less are provided, via a bonding layer, on a support with a total reflectance of 0.5 or more and having an aluminum or aluminum alloy surface with a central plane average roughness of 0.1 to 1.2 μm.

(2) A reflective color photosensitive material in which a cyan-forming layer with an R value of 1.0 or less and, thereon, a magenta-forming layer or yellow-forming layer with an R value of 1.20 or less are provided, via a bonding layer, on a support with a total reflectance of 0.5 or more and having an aluminum or aluminum alloy surface with a central plane average roughness of 0.1 to 1.2 μm.

(3) The case in which the reflective color photosensitive material is a color printing paper.

(4) The case in which the reflective color photosensitive material is a direct positive color printing paper or a reversal color printing paper which is printed from a diapositive.

The invention is now examplained by means of the following Examples. However, the invention is not limited thereto.

EXAMPLE 1

Preparation of a support (1) Support Sample A (FIG. 1)

Metallic aluminum was rough-rolled and then, after rough rolling and annealing treatment on a central roller between upper and lower adjacent rollers, two sheets of aluminum were positioned over each other, and rolled up to provide an aluminum foil having a thickness of about 10 μm. The frequency of irregularities on the surface was 100 to 200 irregularities/mm at a roughness of 0.1 μm or greater. The averaqe roughness at the surface was approximately 0.4 μm as measured by a three-dimensional rouqhness measurinq device, model SE3AK, made by the Kosaka Kenkyu-sho (KK).

Low-density polyethylene was extruded and coated onto a photographic white base paper and the aluminum foil was laminated thereto. Additionally, high-density polyethylene was extruded and coated onto the rear surface of the paper to provide a polyethylene layer of approximately 30 μm. A thin layer of an Ionomer Resin (trade name of products of Mitsui Polychemical Co.; in this example Chemipal S-100 (trade name of a partial zinc salt of an ethylene-methacrylic acid copolymer) was used as Ionomer Resin) was provided on the aluminum surface and, after a corona discharge treatment, a gelatin solution containing the gelatin hardener sodium 1-oxy-3,5-dichloro-s-triazine was coated to provide a subbing layer of 0.1 to 0.2 μm. A cross-sectional figure of this structure is shown in FIG. 1.

Figure 2:
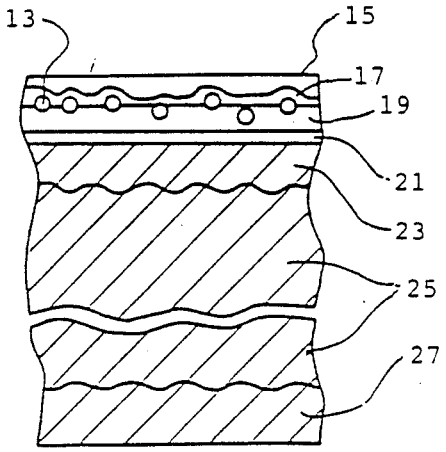

(2) Support Sample B (FIG. 2)

An anchor coating agent having a composition of 20% by weight of the trimethylol propane adduct of tolylene diisocyanate and 80% by weight of a vinylidene chloride copolymer (weight ratio of vinylidene chloride/vinyl chloride/vinyl acetate/anhydrous maleic acid is 16/70/10/4) was dissolved in ethyl acetate and, after drying, was coated to a dry thickness of 0.1 μm on a 26 μm polyethylene terephthalate film impregnated with 2 wt % silica having an average grain size of 3 μm as a plastic film. The film thus prepared was dried in an oven for 2 minutes at 100° C. An aluminum thin film layer having a film thickness of 800 Å was formed on this anchor coat layer on the base by vacuum evaporation deposition at $10^5$ torr. The frequency of irregularities of the surface was approximately 40 to 100 irregularities/mm for a roughness of 0.1 μm or greater. The average roughness on tho surface was approximately 0.6 μm as measured by a three-dimensional roughness measuring device.

A composition for use as a bonding layer containing a 95 parts by weight of a copolymer of vinylidene chloride/vinyl chloride/vinyl acetate/anhydrous maleic acid (10/70/17/3 in a weight ratio) and 5 parts by weight of an adduct of hexamethylene diisocyanate and trimethylol propane was diluted with ethyl acetate, after which it was coated onto the surface of the vapor-deposited thin film layer at a dry amount of 0.2 g/m$^2$, and dried in an oven for 2 minutes at 100° C. to provide the bonding layer.

Next, a timber pulp consisting of 20 parts by weight of LBSP and 80 parts of LBKP was beaten to 300 ml Canadian freeness by means of a disk refiner, and 1.0 parts of sodium stearate, 0.5 parts of anionic polyacrylamide, 1.5 parts of aluminum sulfate, 0.5 parts of polyamidopolyamine epichlorohydrin and 0.5 parts of alkyl ketene dimer were added to the timber pulp, each of these being the absolute dry weight ratio with respect to the timber pulp, and a long-mesh paper-making machine was used to make paper having an average weight of 160 g/m$^2$.

The density was established at 1.0 g/cm$^3$ using a machine calender. The base paper thus prepared was subjected to corona discharge processing. A low density polyethylene resin (MI=7 g/10 min., density 0.923 g/ml) was then coated thereon to a thickness of 30 μm by extrusion to form a polyethylene layer. Afterwards, the other surface (rear surface) of the base was subjected to a corona discharge treatment and coated with a high-density polyethylene (MI=8 g/10 min., density 0.950 g/cc) by extrusion on the other surface to form a both surface polyethylene-coated laminate.

Next, a polyurethane-based two liquid type bonding agent with the following composition was coated onto the rear surface (the surface opposite the vapor-deposited surface) of the above described aluminum vapor-deposited film in a dry amount of 3 g/m$^2$. The drying was carried out for 2 minutes at 100° C.

| | | |
|---|---|---|
| Bonding agent | Polypondo AY-651 A (made by Sanyo Kasei Kogyo) | 100 parts by weight |
| | Polypondo AY-651 C (made by Sanyo Kasei Kogyo) | 15 parts by weight |

The thus coated surface and the low-density polyethylene surface of the paper which had been laminated on both sides with polyethylene were matched and pressure bonded with heating at a pressure of 10 kg/cm at 80° C. A cross-sectional figure of this structure is shown in FIG. 1.

Then, a gelatin subbing layer of approximately 0.1 μm was provided on the bonding layer and an antistatic layer consisting of colloidal alumina and poly(vinylidene chloride) was provided on the polyethylene lamination on the rear surface.

(3) Support Sample C

Sample C was obtained in the same way as support sample B except that polyethylene phthalate film was employed and the matting agent silica was not used in the plastic film. The aluminum surface of Sample C had a mirrored surface, and the surface roughness was 0.05 μm or less.

The total reflectance of the metal surfaces of each of the subbed supports thus obtained was measured using the Model 307 color analyzer made by Hitachi Seisakusho. Furthermore, measurements were also made of the spectrally diffused light reflectance for regularly reflected light irradiated onto the sample at 7° to the normal direction, and with removing the regularly reflected light by providing a trap of 10° with respect to the viewing angle. The results are shown in Table 1.

TABLE 1

| Support Sample | | Wavelength 420 nm* | 550 nm | 680 nm |
|---|---|---|---|---|
| A | Total reflectance | 0.79 | 0.77 | 0.76 |
| | Diffused light reflectance | 0.75 | 0.74 | 0.72 |
| B | Total reflectance | 0.83 | 0.83 | 0.82 |
| | Diffused light reflectance | 0.80 | 0.79 | 0.78 |
| C | Total reflectance | 0.78 | 0.80 | 0.77 |
| | Diffused light reflectance | not more than 0.05 | not more than 0.05 | not more than 0.05 |

*in the wavelength region of 420 nm and below, there was a tendency towards a reduction of total reflectance and diffused light reflectance due to the spectral absorption of the undercoating layer.

When observing the diffused light at about 10° to the normal direction of the support at a viewing angle of about 30°, Samples A and B showed higher luminances than both sample C and a paper support which had been laminated on both sides with polyethylene.

Production of Color Printing Papers

Multi-layer color printing papers with the layer compositions shown below were prepared on a paper support which had been laminated on both sides with polyethylene and on the supports A, B and C which had been prepared as described above. Coating solutions were prepared as described below.

Preparation of the First Layer Coating Solution 19.1 g of the yellow coupler (ExY), 4.4 g of the color image stabilizer (Cpd-1) and 1.8 g of the color image stabilizer (Cpd-7) were dissolved by the addition of 27.2 ml of ethyl acetate and 4.1 g respectively of the solvents (Solv-3) and (Solv-6). The solution thus prepared was emulsified and dispersed in 185 ml of a 10% aqueous gelatin solution containing 8 ml of 10% sodium dodecylbenzenesulfonate. Meanwhile, a blue-sensitive emulsion was prepared by adding $5.0\times10^{-4}$ mole of the blue-sensitizing dye shown below per mole of silver to a sulfur sensitized silver chlorobromide emulsion (a 1:3 mixture (Ag molar ratio) of two silver chlorobromide emulsions, the first comprising silver bromide 80.0 mol %, cubic grain form, average grain size of 0.85 μm, variation coefficient of 0.08; and the second comprising silver bromide 80.0 mol %, cubic grain form, average grain size of 0.62 μm, and variation coefficient of 0.07). The above described emulsified dispersion and the silver chlorobromide emulsion were mixed and dissolved to prepare the first layer coating solution with the composition shown hereinafter.

The coating solutions for the second layer to the seventh layer were prepared by similar methods as that for the first layer coating solution Sodium 1-oxy-3,5-dichloro-s-triazine was used as a gelatin hardener in each layer.

The following were used as spectrally sensitizing dyes in each layer.

Blue-Sensitive Emulsion Layer

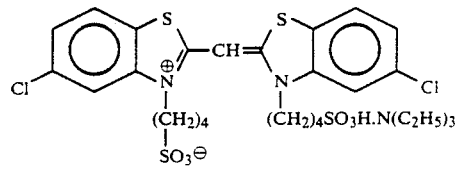

($5.0\times10^{-4}$ mole per mole of silver halide)

Green-Sensitive Emulsion Layer

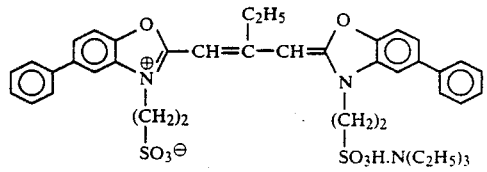

($4.0\times10^{-4}$ mole per mole of silver halide) and

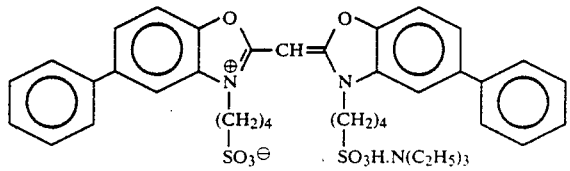

($7.0\times10^{-5}$ mole per mole of silver halide)

Red-Sensitive Emulsion Layer

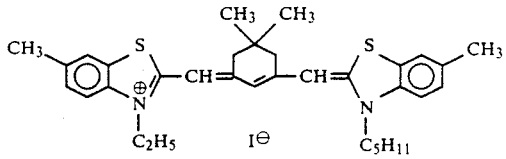

($0.9\times10^{-4}$ mole per mole of silver halide)

The following compound was added to the red-sensitive emulsion layer in an amount of $2.6\times10^{-3}$ mole per mole of silver halide.

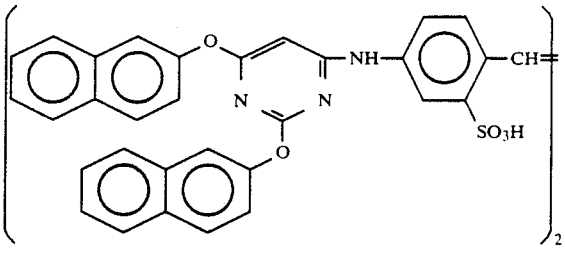

$4.0\times10^{-6}$ mole, $3.0\times10^{-5}$ mole and $1.0\times10^{-5}$ mole of 1-(5-methylureidophenyl)-5-mercaptotetrazole and $8\times10^{-3}$ mole, $2\times10^{-2}$ mole of 2-methyl-5-t-octylhydroquinone were added for each mole of silver halide in the blue-sensitive emulsion layer, green-sensitive emulsion layer and red-sensitive emulsion layer, respectively.

$1.2\times10^{-2}$ mole and $1.1\times10^{-2}$ mole of 4-hydroxy-6-methyl-1,3,3a,7-tetraazaindene were added per mole of silver halide to the blue-sensitive emulsion layer and green-sensitive emulsion layer, respectively.

The following dyes were added to the emulsion layers to prevent irradiation.

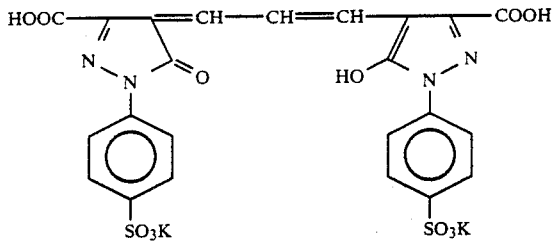

and

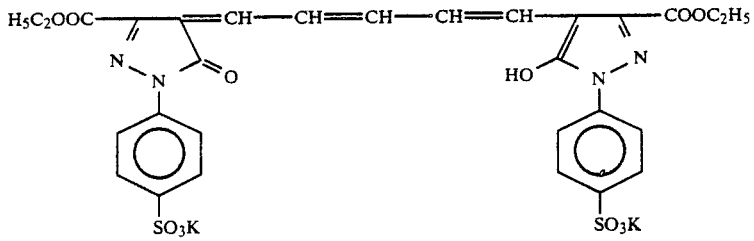

Layer Compositions

The composition of each layer is given below. The figures represent coated amounts (g/m²). For the silver halide emulsions, the coated amounts are calculated as silver.

Support

| | |
|---|---|
| Polyethylene-laminated paper [containing a white pigment ($TiO_2$) and a blue dye (ultramarine) in the polyethylene layer on the first layer side] or support sample A, B or C shown in Table 2 | |
| First layer (blue-sensitive layer) | |
| Silver chlorobromide emulsion described above (AgBr: 80 mol %) | 0.26 |
| Gelatin shown in Table 2 | |
| Yellow coupler (ExY) | 0.83 |
| Color image stabilizer (Cpd-1) | 0.19 |
| Color image stabilizer (Cpd-7) | 0.08 |
| Solvent (Solv-3) | 0.18 |
| Solvent (Solv-6) | 0.18 |
| Second layer (color mixing prevention layer) | |
| Gelatin | 0.99 |
| Color mixing preventor (Cpd-5) | 0.08 |
| Solvent (Solv-1) | 0.16 |
| Solvent (Solv-4) | 0.08 |
| Third layer (green-sensitive layer) | |
| Silver chlorobromide emulsion (a 1:1 mixture (Ag molar ratio) of AgClBr containing AgBr 90 mol %, cubic, average grain size 0.47 μm, variation coeficient 0.12 and AgClBr containing AgBr 90 mol %, cubic, average grain size 0.36 μm, variation coefficient 0.09) | 0.16 |
| Gelatin | 1.79 |
| Magenta coupler (ExM-1) | 0.32 |
| Color image stabilizer (Cpd-2) | 0.02 |
| Color image stabilizer (Cpd-3) | 0.20 |
| Color image stabilizer (Cpd-4) | 0.01 |
| Color image stabilizer (Cpd-8) | 0.03 |
| Color image stabilizer (Cpd-9) | 0.04 |
| Solvent (Solv-2) | 0.65 |
| Fourth layer (ultraviolet absorbing layer) | |
| Gelatin | 1.58 |
| Ultraviolet absorber (UV-1) | 0.47 |
| Color mixing preventor (Cpd-5) | 0.05 |
| Solvent (Solv-5) | 0.24 |
| Fifth layer (red-sensitive layer) | |
| Silver chlorobromide emulsion (a 1:2 mixture (Ag molar ratio) of AgClBr containing AgBr 70 mol %, cubic, average grain size 0.49 μm, variation coefficient 0.08, AgClBr containing AgBr 70 mol %, cubic, average grain size 0.34 μm, variation | 0.23 |

-continued

| | |
|---|---|
| coefficient 0.10) | |
| Gelatin | 1.34 |
| Cyan coupler (ExC) | 0.30 |
| Color image stabilizer (Cpd-6) | 0.17 |
| Color image stabilizer (Cpd-7) | 0.40 |
| Solvent (Solv-6) | 0.20 |
| Sixth layer (ultraviolet absorbing layer) | |
| Gelatin | 0.53 |
| Ultraviolet absorber (UV-1) | 0.16 |
| Color mixing preventor (Cpd-5) | 0.02 |
| Solvent (Solv-5) | 0.08 |
| Seventh layer (protective layer) | |
| Gelatin | 1.33 |
| Acrylic modified copolymer of polyvinyl alcohol (degree of modification 17%) | 0.17 |
| Liquid paraffin | 0.03 |

(Cpd-1) color image stabilizer

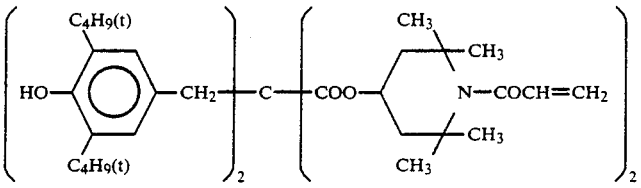

(Cpd-2) color image stabilizer

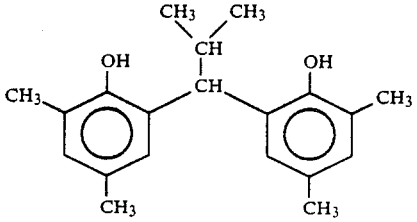

(Cpd-3) color image stabilizer

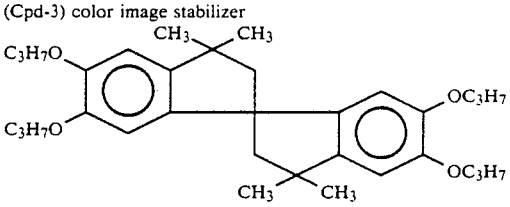

(Cpd-4) color image stabilizer

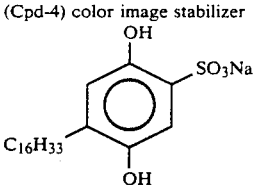

(Cpd-5) color mixing preventor

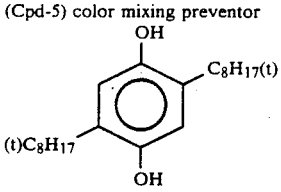

(Cpd-6) color image stabilizer
a 2:4:4 (weight ratio) mixture of

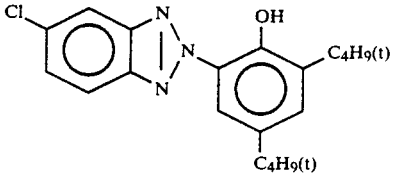

-continued
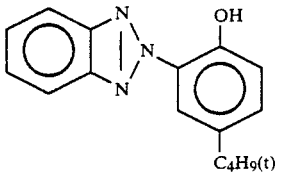
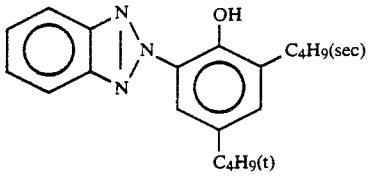
(Cpd-7) color image stabilizer
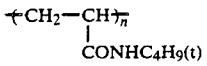
average molecular weight 80,000
(Cpd-8) color image stabilizer
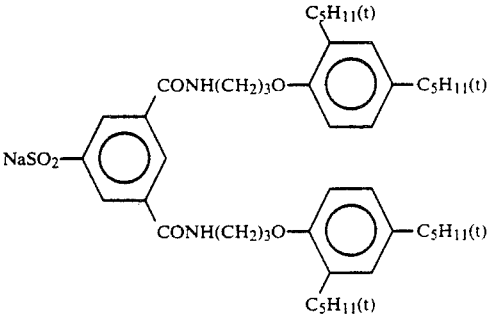
(Cpd-9) color image stabilizer
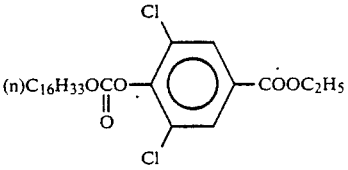
(UV-1) ultraviolet absorber
a 4:2:4 (weight ratio) mixture of
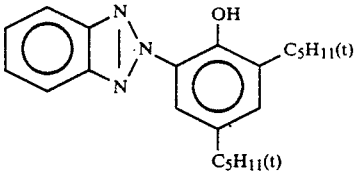
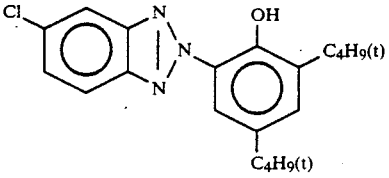

-continued
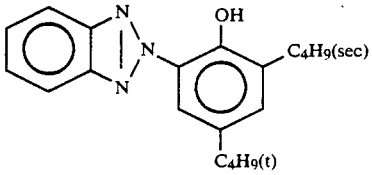
(Solv-1) solvent
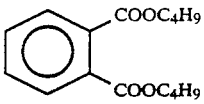
(Solv-2) solvent
a 2:1 (weight ratio) mixture of
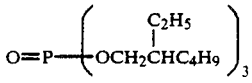
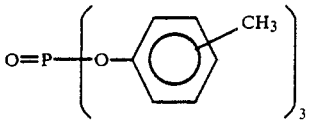
(Solv-3) solvent
$O{=}P{\leftarrow}O{-}C_9H_{19}(iso))_3$
(Solv-4) solvent
(Solv-5) solvent
$COOC_8H_{17}$
|
$(CH_2)_8$
|
$COOC_8H_{17}$
(solv-6) solvent
$C_8H_{17}CH\ \ CH(CH_2)_7COOC_8H_{17}$
$\backslash\ /$
$O$
(ExY) yellow coupler
a 1:1 (molar ratio) mixture of
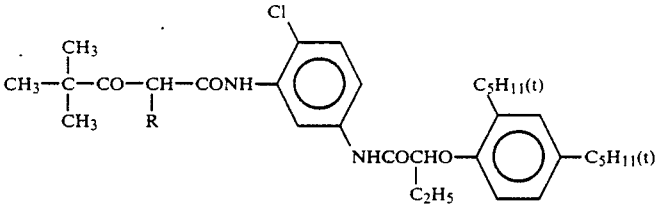
R =
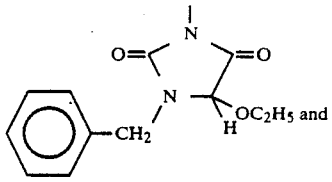
R =
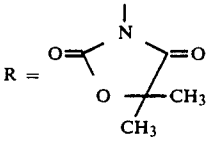
(ExM) magenta coupler -continued a 1:1 (molar ratio) mixture of

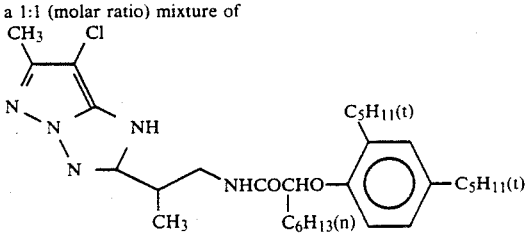

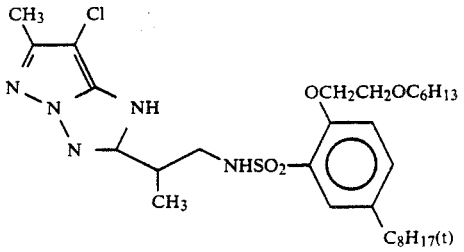

(ExC) cyan coupler
a 1:1 (molar ratio) mixture of

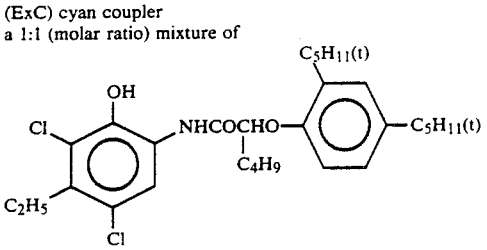

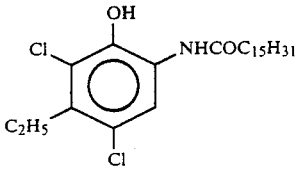

The R values of each of the photosensitive layers obtained were as follows.

| | |
|---|---|
| First layer (blue-sensitive layer) | given in Table 2 |
| Third layer (green-sensitive layer) | 1.11 |
| Fifth layer (red-sensitive layer) | 0.96 |

TABLE 2

| Color photo-sensitive material sample No. | Sample used | First layer (blue-sensitive layer) Amount of gelatin used g/m² | R value |
|---|---|---|---|
| 1 | Paper support laminated on both sides with polyethylene | 1.83 | 0.97 |
| 2 | A | 1.60 | 0.85 |
| 3 | A | 1.83 | 0.97 |
| 4 | A | 2.10 | 1.11 |
| 5 | A | 2.31 | 1.23 |
| 6 | B | 1.60 | 0.85 |
| 7 | B | 1.83 | 0.97 |
| 8 | B | 2.10 | 1.11 |
| 9 | B | 2.31 | 1.23 |
| 10 | C | 1.60 | 0.85 |
| 11 | C | 1.83 | 0.97 |
| 12 | C | 2.10 | 1.11 |

TABLE 2-continued

| Color photo-sensitive material sample No. | Sample used | First layer (blue-sensitive layer) Amount of gelatin used g/m² | R value |
|---|---|---|---|
| 13 | C | 2.31 | 1.23 |

The color photosensitive material Samples 1 to 13 were each prepared as roll samples by cutting to a 117 mm width. Images were printed from a color negative film original obtained from a Fujicolor Super HG-400 negative film. Furthermore, each sample was subjected to graded exposure with sensitometric three-color separation filters using a sensitometer (model FWH made by Fuji Photographic Film Co. Ltd., with a light source color temperature of 3,200° K.). The samples were exposed to provide an exposure of 250 cms over an exposure period of 0.1 seconds.

After the exposure, the Fuji color paper processing apparatus PP600 was used to carry out continuous processing (a running test) in accordance with the color development processing A described below, until twice the color development tank capacity had been replenished. For the processed samples, sample 1 was processed alone and each of samples 2–13 was processed with the same amount of sample 1 in a running test.

Furthermore, the prints obtained by processing the samples 1 to 13 were cut to provide prints having a size of 117 mm 82.5 mm. Evaluations were carried out with respect to the extent of film peeling in the vicinity of the edges and with respect to the extent of staining of edges which has been contacted with the processing solution, wherein 10 sheets were overlapping.

The results are given in Table 3.

Color developing process A

| Processing stage | Temperature | Time | Replenishment amount* | Tank capacity |
|---|---|---|---|---|
| Color development | 38° C. | 1 min. 40 sec. | 290 ml | 17 l |
| Bleach-fixing | 33° C. | 60 sec. | 150 ml | 9 l |
| Rinse (1) | 30–34° C. | 20 sec. | — | 4 l |
| Rinse (2) | 30–34° C. | 20 sec. | — | 4 l |
| Rinse (3) | 30–34° C. | 20 sec. | 664 ml | 4 l |
| Drying | 70–80° C. | 50 sec. | | |

*Per 1 $m^2$ of photosensitive material

A three-tank countercurrent system from rinse (3) (1) was employed.

The compositions of the various processing solutions were as given below.

| | Tank solution | Replenishment solution |
|---|---|---|
| Color developing solution | | |
| Water | 800 ml | 800 ml |
| Diethylenetriaminepentaacetic acid | 1.0 g | 1.2 g |
| Nitrilotriacetic acid | 2.0 g | 2.5 g |
| Benzyl alcohol | 16 ml | 22 ml |
| Diethylene glycol | 10 ml | 10 ml |
| Sodium sulfite | 2.0 g | 2.5 g |
| Potassium bromide | 0.5 g | — |
| Potassium carbonate | 30 g | 30 g |
| N-Ethyl-N-(β-methanesulfonamidoethyl)-3-methyl-4-aminoaniline sulfate | 5.5 g | 7.5 g |
| Hydroxylamine sulfate | 2.0 g | 2.5 g |
| Fluorescent brightener (WHITEX 4B, Sumitomo Kagaku) | 1.5 g | 2.0 g |
| Water to | 1,000 ml | 1,000 ml |
| pH (25° C.) | 10.20 | 10.60 |
| Bleach-fixing solution | | |
| Water | 400 ml | 400 ml |
| Ammonium thiosulfate (700%) | 200 ml | 300 ml |
| Sodium sulfite | 20 g | 40 g |
| Iron(III) ammonium ethylenediaminetetraacetate | 60 g | 120 g |
| Disodium ethylenediaminetetraacetate | 5 g | 10 g |
| Water to | 1,000 ml | 1,000 ml |
| pH (25° C.) | 6.70 | 6.30 |

Rinse Solution

Ion exchange water (calcium and magnesium each of 3 ppm or less)

TABLE 3

| Color photosensitive material sample No. | Support used | R value of the first layer | Edge discoloration | Film peeling | Remarks |
|---|---|---|---|---|---|
| 1 | Polyethylene-laminated paper | 0.97 | ◎ | ○ | (Reference) |
| 2 | A | 0.85 | ◎ | ○ | (This invention) |
| 3 | A | 0.97 | ○ | ○ | (This invention) |
| 4 | A | 1.11 | ○ | Δ | (This invention) |
| 5 | A | 1.23 | Δ | x | (Comparative) |
| 6 | B | 0.85 | ◎ | ○ | (This invention) |
| 7 | B | 0.97 | ○ | ○ | (This invention) |
| 8 | B | 1.11 | ○ | ○ | (This invention) |
| 9 | B | 1.23 | Δ | Δ | (Comparative) |
| 10 | C | 0.85 | ○ | ○ | (Comparative) |
| 11 | C | 0.97 | ○ | ○ | (Comparative) |
| 12 | C | 1.11 | ○ | Δ | (Comparative) |
| 13 | C | 1.23 | x | x | (Comparative) |

where:

edge stain excellent with no staining no staining observed

Δ staining observed staining, unacceptable.

film peeling none

Δ slight peeling observed at the edges, but at an acceptable level film peeling observed.

It is clearly seen that when using the color development process A, edge discoloration and film peeling are at an acceptable level when the R value of the first layer is 1.20 or less, and are outstanding at an R value of 1.0 or less and in particular at an R value of 0.90. Furthermore, it is seen that a color development process may be carried out that is common to conventional paper support samples which have been laminated on both sides using polyethylene, while the edge stain and film peeling were little.

EXAMPLE 2

Multi-layer color printing papers with the layer compositions shown below were produced on either support sample A or B which had been prepared as in Example 1. Coating solutions were prepared as described below.

Preparation of the First Layer Coating Solution 19.1 g of the yellow coupler (ExY), 4.4 g of the color image stabilizer (Cpd-1) and 0.7 g of the color image stabilizer (Cpd-7) were dissolved by of the addition of 27.2 ml of ethyl acetate and 8.2 g the solvent (Solv-3) This solution was emulsified and dispersed in 185 ml of a 10% aqueous gelatin solution containing 8 ml of 10% sodium dodecylbenzenesulfonate. Meanwhile, a blue-sensitive emulsion was prepared in which the blue-sensitizing dyes shown below had been added to a silver chlorobromide emulsion (a 3:7 mixture (silver molar ratio) of 0.88 μm and a 0.70 μm average grain size cubic emulsions, grain size distribution variation coefficients 0.08 and 0.10, each emulsion locally containing 0.2 mol % of silver bromide on the grain surfaces) in an amount of $2.0\times10^{-4}$ mole for the large grain size emulsion and in an amount of $2.5\times10^{-4}$ mole for the small grain size emulsion per mole of silver, and this emulsion was then sulfur sensitized. The above described emulsified dispersion and the thus prepared emulsion were mixed and dissolved, and a first coating solution was prepared constituting the composition shown hereinafter. Coating solutions for the second layer to the seventh layer were prepared by the same method as that for the first layer coating solution. Sodium 1-oxy- 3,5-dichloro-s-triazine was used as a gelatin hardener in each layer.

The following were used as spectrally sensitizing dyes in each layer.

Blue-Sensitive Emulsion Layer

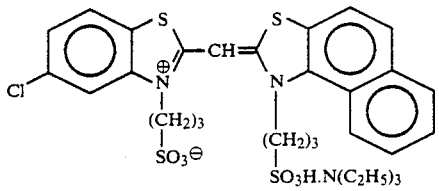

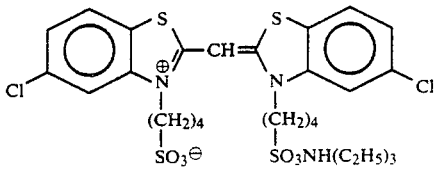

(each used in an amount of $2.0\times10^{-4}$ mole for the large grain size emulsion and in an amount of $2.5\times10^{-4}$ mole for the small grain size emulsion per mole of silver halide)

Green-Sensitive Emulsion Layer

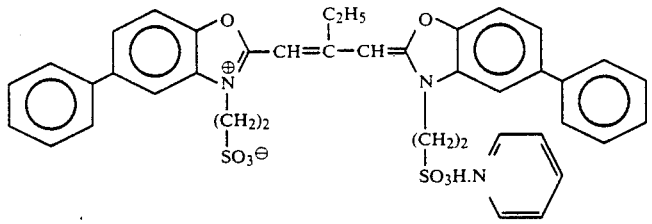

(used in an amount of $4.0\times10^{-4}$ mole for the large grain size emulsion and in an amount of $5.6\times10^{-4}$ mole for the small grain size emulsion per mole of silver halide) and

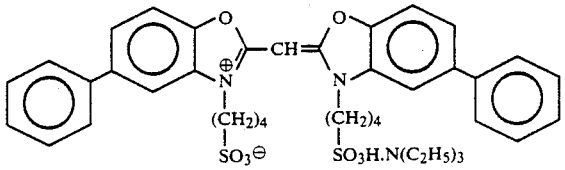

(used in an amount of $7.0\times10^{-5}$ mole for the large grain size emulsion and in an amount of $1.0\times10^{-5}$ mole for the small grain size emulsion per mole of silver halide)

Red-Sensitive Emulsion Layer

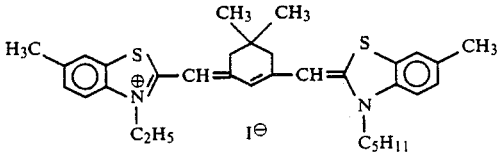

(used in an amount of $0.9\times10^{-4}$ mole for the large grain size emulsion and in an amount of $1.1\times10^{-4}$ mole for the small grain size emulsion per mole of silver halide)

The following compound was added to the red-sensitive emulsion layer in an amount of $2.6\times10^{-3}$ mole per mole of silver halide.

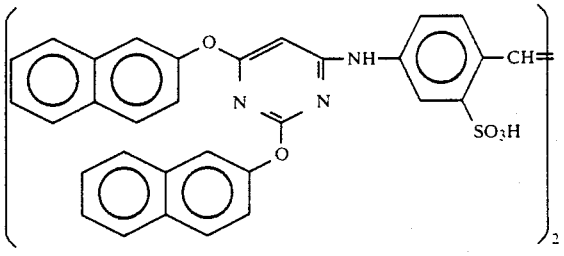

Furthermore, 1-(5-methylureidophenyl)-5-mercaptotetrazole was added in an amount of $8.5\times10^{-5}$ mole, $7.7\times10^{-4}$ mole and $2.5\times10^{-4}$ mole per mole of silver halide to the blue-sensitive emulsion layer, green-sensitive emulsion layer and red-sensitive emulsion layer, respectively.

The following dyes were added to the emulsion layers to prevent irradiation.

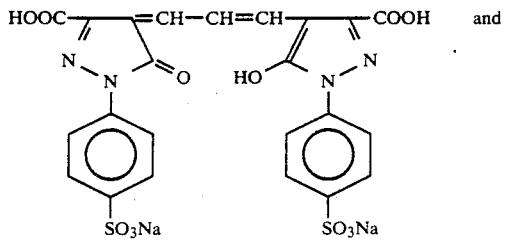

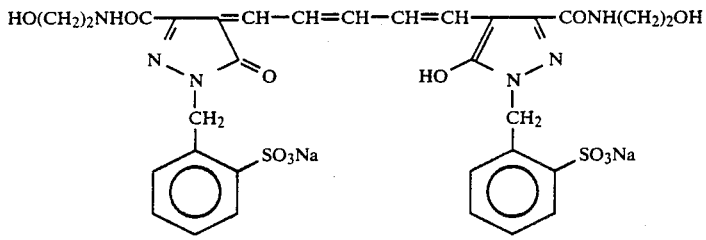

Layer Compositions

The compositions of the various layers are shown below. The figures represent coated amounts (g/m$^2$). For the silver halide emulsions, the coated amounts are calculated as silver.

Support

| | |
|---|---|
| Polyethylene-laminated paper | |
| [containing a white pigment ($TiO_2$) and a blue dye (ultramarine) in the polyethylene layer on the first layer side] or the support samples A and B | shown in Table 4 |
| First layer (blue-sensitive layer) | |
| Silver chlorobromide emulsion described above | 0.30 |
| Gelatin | shown in Table 4 |
| Yellow coupler (ExY) | " |
| Color image stabilizer (Cpd-1) | " |
| Solvent (Solv-3) | " |
| Color image stabilizer (Cpd-7) | " |
| Second layer (color mixing prevention layer) | |
| Gelatin | 0.99 |
| Color mixing preventor (Cpd-5) | 0.08 |
| Solvent (Solv-1) | 0.16 |
| Solvent (Solv-4) | 0.08 |
| Third layer (green-sensitive layer) | |
| Silver chlorobromide emulsion (a 1:3 mixture (Ag molar ratio) of cubic emulsions with average grain sizes of 0.55 μm and 0.39 μm. Grain size distribution variation coefficients 0.10 and 0.08; 0.8 mol % of AgBr being locally contained on the grain surfaces of each emulsion) | 0.12 |
| Gelatin | shown in Table 4 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |
| Fourth layer (ultraviolet absorbing layer) | |
| Gelatin | 1.58 |
| Ultraviolet absorber (UV-1) | 0.47 |
| Color mixing preventor (Cpd-5) | 0.05 |
| Solvent (Solv-5) | 0.24 |
| Fifth layer (red-sensitive layer) | |
| Silver chlorobromide emulsion (a 1:4 mixture (Ag molar ratio) of cubic emulsions with average grain sizes of 0.58 μm, and 0.45 μm. Grain size distribution variation coefficients 0.09 and 0.11, 0.6 mol % of AgBr being locally contained in a portion of the grain surfaces in each emulsion) | 0.23 |
| Gelatin | shown in Table 4 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth layer (ultraviolet absorbing layer) | |
| Gelatin | 0.53 |
| Ultraviolet absorber (UV-1) | 0.16 |

-continued

| | |
|---|---|
| Color mixing preventor (Cpd-5) | 0.02 |
| Solvent (Solv-5) | 0.08 |
| Seventh layer (protective layer) | |
| Gelatin | 1.33 |
| Acrylic modified copolymer of polyvinyl alcohol (degree of modification 17%) | 0.17 |
| Liquid paraffin | 0.03 |

(ExY) Yellow coupler

A 1:1 (molar ratio) mixture of

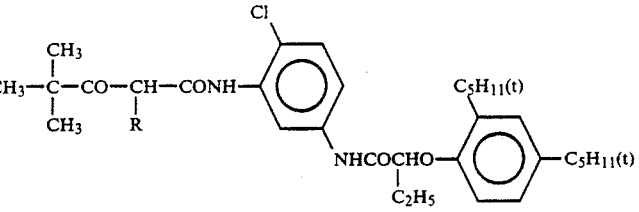

R =

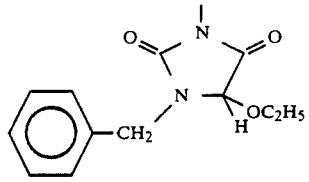

and R =

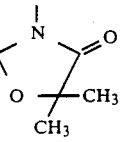

(ExM) Magenta coupler

A 1:1 (molar ratio) mixture of

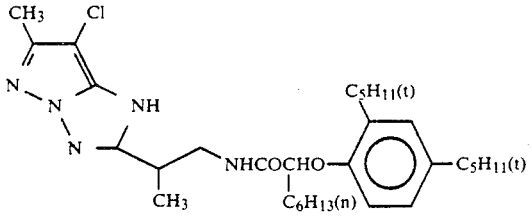

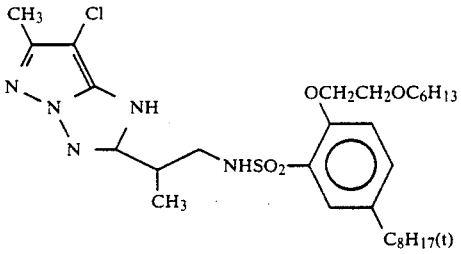

(ExC) Cyan coupler

A 2:4:4 (by weight) mixture of

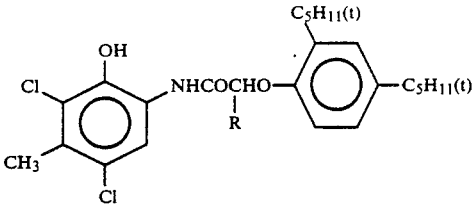

R = $C_2H_5$ and $C_4H_9$ and

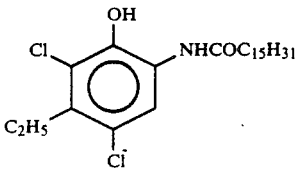

(Cpd-1) Color image stabilizer

-continued
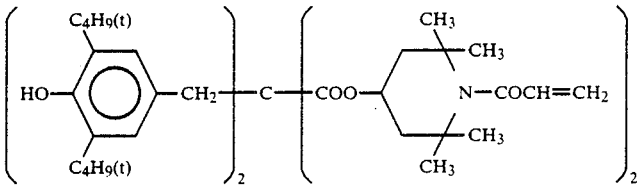
(Cpd-2) Color image stabilizer
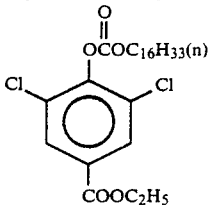
(Cpd-3) Color image stabilizer
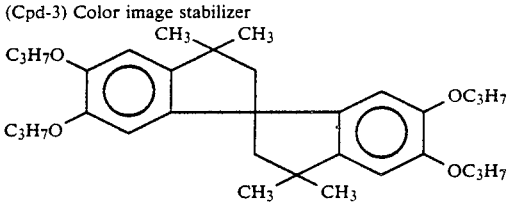
(Cpd-4) Color image stabilizer
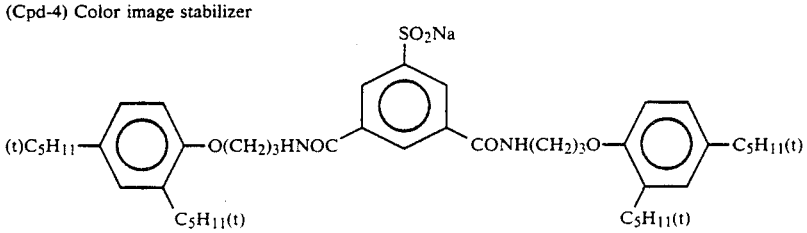
(Cpd-5) Color mixing preventor
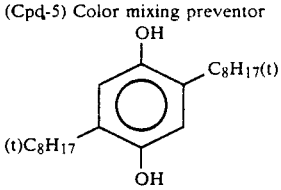
(Cpd-6) Color image stabilizer
A 2:4:4 (by weight) mixture of
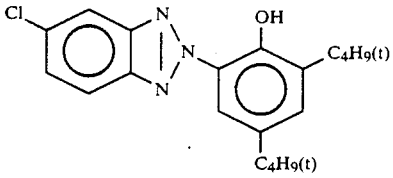
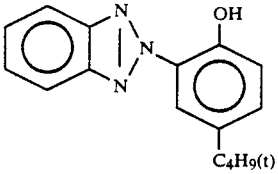
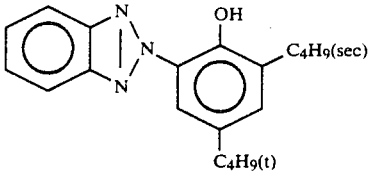
(Cpd-7) Color image stabilizer
$$\left(CH_2-\underset{\substack{|\\ CONHC_4H_9(n)}}{CH}\right)_n$$
average molecular weight 60,000
(Cpd-8) Color image stabilizer -continued
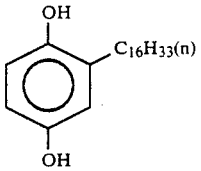
(Cpd-9) Color image stabilizer
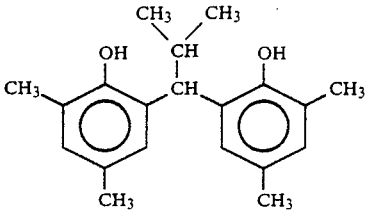
(UV-1) Ultraviolet absorber
A 4:2:4 (by weight) mixture of
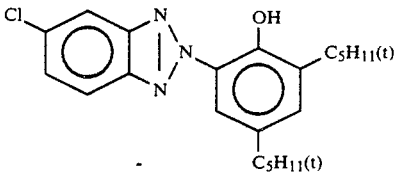
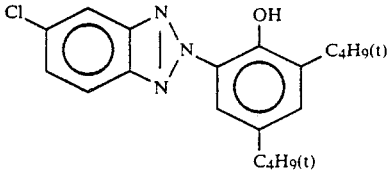
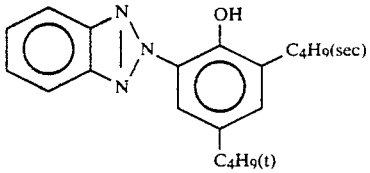
(Solv-1) Solvent
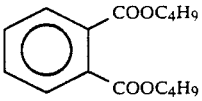
(Solv-2) Solvent
A 2:1 (volume ratio) mixture of $O{=}P\left(OCH_2\underset{}{\overset{C_2H_5}{C}}HC_4H_9\right)_3$ and
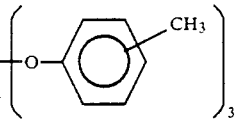
(Solv-3) Solvent
$O{=}P(O{-}C_9H_{19}(iso))_3$
(Solv-4) Solvent
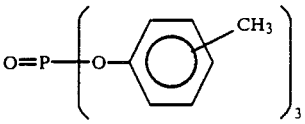
(Solv-5) Solvent
$$\begin{array}{l} COOC_8H_{17} \\ | \\ (CH_2)_8 \\ | \\ COOC_8H_{17} \end{array}$$
(Solv-6) Solvent -continued

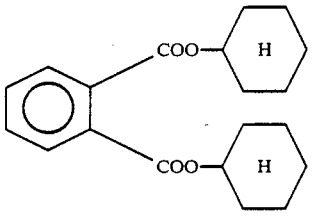

Tests were carried out in the same manner as in Example 1, except that the following color processing solution B was used. The results for edge stain and film peeling are given in Table 4.

Color Developing Process A

| Processing stage | Temperature | Time | Replenishment solution | Tank capacity |
|---|---|---|---|---|
| Color development | 35° C. | 45 sec. | 161 ml | 17 l |
| Bleach-fixing | 30–35° C. | 45 sec. | 215 ml | 17 l |
| Rinse (1) | 30–35° C. | 20 sec. | — | 10 l |
| Rinse (2) | 30–35° C. | 20 sec. | — | 10 l |
| Rinse (3) | 30–35° C. | 20 sec. | 350 ml | 10 l |
| Drying | 70–80° C. | 60 sec. | | |

The replenishment amount is per 1 $m^2$ of the photosensitive material (a three-tank countercurrent system from rinse (3) (1) was employed)

The compositions of the various processing solutions are as given below.

| Color developer | Tank solution | Replenishment solution |
|---|---|---|
| Water | 800 ml | 800 ml |
| Ethylenediamine-N,N,N',N'-tetramethylene phosphonate | 1.5 g | 2.0 g |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 5.5 g | 7.0 g |

-continued

| Color developer | Tank solution | Replenishment solution |
|---|---|---|
| Fluorescent brightener (WHITEX 4B, Sumitomo Kagaku) | 1.0 g | 2.0 g |
| Water to | 1,000 ml | 1,000 ml |
| pH (25° C.) | 10.05 | 10.45 |

Bleach-Fixing Solution

| | |
|---|---|
| Water | 400 ml |
| Ammonium thiosulfate (700 g/l) | 100 ml |
| Sodium sulfite | 17 g |
| Iron(III) ammonium ethylenediaminetetraacetate | 55 g |
| Disodium ethylenediaminetetraacetate | 5 g |
| Ammonium bromide | 40 g |
| Water to | 1,000 ml |
| pH (25° C.) | 6.0 |

Rinse Solution

Ion exchanged water (no more than 3 ppm of calcium and magnesium respectively)

TABLE 4

| Color photosensitive material sample No. | 14 | 15 | 16 | 17 | 18 | 19 | 20 | 21 |
|---|---|---|---|---|---|---|---|---|
| First layer (composition of the red-sensitive layer) | | | | | | | | |
| R value | 0.85 | 1.01 | 1.23 | 1.23 | 0.85 | 1.01 | 1.23 | 1.23 |
| The above silver chlorobromide emulsion: | | | | | | | | |
| silver amount | 0.30 | 0.30 | 0.30 | 0.30 | 0.30 | 0.30 | 0.30 | 0.30 |
| Gelatin | 1.60 | 1.86 | 2.27 | 2.27 | 1.60 | 1.86 | 2.27 | 2.27 |
| Yellow coupler (ExY) | 0.82 | 0.82 | 0.82 | 0.82 | 0.82 | 0.82 | 0.82 | 0.82 |
| Color image stabilizer (Cpd-1) | 0.19 | 0.19 | 0.19 | 0.19 | 0.19 | 0.19 | 0.19 | 0.19 |
| Solvent (Solv-3) | 0.35 | 0.35 | 0.35 | 0.35 | 0.35 | 0.35 | 0.35 | 0.35 |
| Color image stabilizer (Cpd-7) | 0.10 | 0.06 | 0.10 | 0.10 | 0.10 | 0.06 | 0.10 | 0.10 |
| Third layer (green-sensitive layer) | | | | | | | | |
| R value | 1.02 | 1.02 | 1.18 | 1.33 | 1.02 | 1.02 | 1.18 | 1.33 |
| Amount of gelatin used | 1.07 | 1.07 | 1.24 | 1.36 | 1.07 | 1.07 | 1.24 | 1.36 |
| Fifth layer (red-sensitive layer) | | | | | | | | |
| R value | 1.02 | 1.02 | 1.02 | 1.10 | 1.02 | 1.02 | 1.02 | 1.10 |
| Amount of gelatin used | 1.34 | 1.34 | 1.34 | 1.45 | 1.34 | 1.34 | 1.34 | 1.45 |
| Support used | B | B | B | B | A | A | A | A |
| Results | | | | | | | | |
| Edge discoloration | ◎ | ○ | Δ | x | ○ | ○ | Δ | x |
| Film peeling | ○ | ○ | Δ | Δ | ○ | ○ | x | x |

The present invention provides a color photosensitive material comprising a support having a metal surface with secondary diffuse reflection, which may be subject to color development processing similar to, or in common with, that of color photosensitive materials comprising conventional supports laminated on both sides with polyethylene, and which provide prints having an excellent saturation, image sharpness and a high luminance without any film peeling or edge stain.

While the invention has been described in detail and with reference to specific embodiment thereof, it will be apparent to one skilled in the art that various changes and modifications can be made therein without departing from the spirit and scope thereof.

What is claimed is:

1. A silver halide color photosensitive material comprising a support having a metal surface with secondary diffuse reflection and a total reflectance of 0.5 or more in the visible wavelength region of 420 to 680 nm, said support having provided thereon a photosensitive silver halide emulsion layer containing a yellow coupler, a photosensitive silver halide emulsion layer containing a magenta coupler, and a photosensitive silver halide emulsion layer containing a cyan coupler and at least one non-photosensitive hydrophilic colloid layer, wherein the volume ratio R of the hydrophilic constituents in each photosensitive silver halide emulsion layer with respect to the non-hydrophilic constituents therein is 1.30 or less, and the photosensitive silver halide emulsion layer containing a color coupler which is arranged nearest the support has an R value of 1.20 or less.

2. A silver halide color photosensitive material as in claim 1, wherein the surface of the support has a total reflectance of from 0.5 to 1.0.

3. A silver halide color photosensitive material as in claim 1, wherein the metal surface has a surface irregularity of 0.1 to 2,000 irregularities/mm as the frequency for a roughness of 0.1 μm or more.

4. A silver halide photosensitive material as in claim 1, wherein the three dimensional average roughness of the metal surface of the support with respect to the central plane of the metal surface is 0.1 to 2.0 μm.

5. A silver halide color photosensitive material as in claim 1, wherein the metal is selected from the group consisting of silver, aluminum, magnesium and alloys thereof.

6. A silver halide color photosensitive material as in claim 5, wherein the alloy is an aluminum alloy comprising aluminum and at least one metal selected from the group consisting of magnesium, zinc, tin and copper.

7. A silver halide color photosensitive material as in claim 1, wherein the support composes a metal layer laminated on a base in a thickness of at least 300 Å.

8. A silver halide color photosensitive material as in claim 1, wherein the R value of each of the photosensitive silver halide emulsion layer is 0.40 to 1.30.

9. A silver halide color photosensitive material as claimed in claim 1, wherein the photosensitive silver halide emulsion layer arranged nearest the support has an R value of 1.00 or less.

10. A silver halide color photosensitive material as in claim 1, wherein the photosensitive silver halide emulsion layers are provided on the support via a bonding layer.

11. A silver halide color photosensitive material as in claim 10, wherein the bonding layer is composed of a water-resistant resin.

12. A silver halide color photosensitive material as in claim 1, wherein the photosensitive silver halide emulsion layers are provided on the support via a subbing layer.

13. A silver halide color photosensitive material as in claim 12, wherein the subbing layer is composed of gelatin.

14. A silver halide color photosensitive material as in claim 10, wherein the photographic silver halide emulsion layers are provided on the bonding layer via a subbing layer.

15. A silver halide color photosensitive material as in claim 1, wherein the support is composed of a base having thereon a metal layer, and said base is composed of a plastic film.

16. A silver halide color photosensitive material as in claim 1, wherein the support is provided by laminating a metal layer on a base via an anchor layer.

17. A silver halide color photosensitive material as in claim 16, wherein the anchor layer is composed of a copolymer of vinylidene chloride, vinyl chloride and anhydrous maleic acid.

18. A silver halide color photosensitive material as in claim 16, wherein the anchor layer is composed of a copolymer of vinylidene chloride, vinyl chloride, anhydrous maleic acid and vinyl acetate.

19. A silver halide color photosensitive material as in claim 1, wherein an antistatic layer is provided on the support surface opposite to the surface whereon the metal layer is provided.

20. A silver halide color photosensitive material as in claim 1, wherein said non-photosensitive hydrophilic colloid layer is at least one of an intermediate layer, a filter layer and a protective layer.

21. A silver halide color photosensitive material as in claim 1, wherein the three dimensional average roughness of the metal surface of the support with respect to the central plane of the metal surface is 0.1 to 2.0 μm, the R value of each of the photosensitive layers is 1.25 or less and the photosensitive silver halide emulsion layer containing a color coupler which is arranged nearest the support has an R value of 0.90 or less.

22. A silver halide color photosensitive material as in claim 1, wherein the material is a color printing paper.

* * * * *